US010639810B2

(12) United States Patent
Michaud et al.

(10) Patent No.: US 10,639,810 B2
(45) Date of Patent: May 5, 2020

(54) METHOD AND CUTTING APPARATUS FOR CUTTING BLANK PROFILES

(71) Applicant: MILAN CONCEPTION INC., Sherbrooke (CA)

(72) Inventors: Steeve Michaud, Sherbrooke (CA); Benoit Langlois, Sainte-Catherine-de-Hatley (CA)

(73) Assignee: MILAN CONCEPTION INC., Sherbrooke (CA)

( * ) Notice: Subject to any disclaimer, the term of this patent is extended or adjusted under 35 U.S.C. 154(b) by 0 days.

(21) Appl. No.: 16/348,650

(22) PCT Filed: Oct. 25, 2017

(86) PCT No.: PCT/IB2017/056637
§ 371 (c)(1),
(2) Date: May 9, 2019

(87) PCT Pub. No.: WO2018/091993
PCT Pub. Date: May 24, 2018

(65) Prior Publication Data

US 2020/0055209 A1 Feb. 20, 2020

Related U.S. Application Data

(60) Provisional application No. 62/423,537, filed on Nov. 17, 2016.

(51) Int. Cl.
*B26D 3/14* (2006.01)
*B26D 5/00* (2006.01)
(Continued)

(52) U.S. Cl.
CPC ..... *B26D 3/14* (2013.01); *B26D 5/005* (2013.01); *B26D 5/22* (2013.01); *B26D 7/01* (2013.01); *B26D 7/0625* (2013.01); *B26D 11/00* (2013.01)

(58) Field of Classification Search
CPC . B26D 3/14; B26D 5/005; B26D 5/22; B26D 7/01; B26D 7/0625; B26D 11/00
See application file for complete search history.

(56) References Cited

U.S. PATENT DOCUMENTS 4,554,852 A 11/1985 Sauer et al.
4,601,688 A * 7/1986 Deverell ..... B26D 3/14 493/238

(Continued)

FOREIGN PATENT DOCUMENTS

FR 2635752 B1 * 3/1991 ..... B26D 3/14

OTHER PUBLICATIONS

ISA/CA, International Search Report of PCT/IB2017/056637, Ciprian Galasiu, dated Feb. 2, 2018.

*Primary Examiner* — Omar Flores Sanchez
(74) *Attorney, Agent, or Firm* — BCF LLP

(57) ABSTRACT

A cutting apparatus for cutting blank profiles comprises a first cutting device located at a first position in the apparatus, a second cutting device located at a second position, the second position being separated from the first position along a first axis of the apparatus, and a third cutting device located at a third position, the third position being separated from the first position along a second axis and along a third axis of the apparatus. A chariot moves along the third axis while a support adapted to hold a blank profile is mounted to the chariot and moves along the first and second axes of the apparatus. A greater number of cutting devices may be used. Cutting devices may be arranged in rows along the third axis.

20 Claims, 20 Drawing Sheets

(51) Int. Cl.

| | |
|---|---|
| ***B26D 5/22*** | (2006.01) |
| ***B26D 7/01*** | (2006.01) |
| ***B26D 7/06*** | (2006.01) |
| ***B26D 11/00*** | (2006.01) |

(56) References Cited

U.S. PATENT DOCUMENTS

| | | | | | |
|---|---|---|---|---|---|
| 4,741,236 | A * | 5/1988 | Averill | B23D 45/10 412/16 |
| 4,991,479 | A | 2/1991 | Asano et al. | |
| 5,176,056 | A | 1/1993 | Tagliaferri | |
| 6,119,572 | A | 9/2000 | Korus et al. | |
| 6,134,999 | A | 10/2000 | Herman | |
| 6,142,050 | A * | 11/2000 | Miki | B26D 7/01 83/155 |
| 6,694,852 | B1 | 2/2004 | Ours et al. | |
| 10,328,594 | B2 * | 6/2019 | Knoble | B23Q 7/042 |
| 2017/0151685 | A1 * | 6/2017 | Uno | B26D 7/01 |
| 2017/0157786 | A1 * | 6/2017 | Knoble | B23Q 7/042 |
| 2019/0191727 | A1 * | 6/2019 | Volkl | B26D 5/30 |
| 2019/0223459 | A1 * | 7/2019 | Volkl | A22C 17/002 |
| 2019/0232516 | A1 * | 8/2019 | Volkl | A22C 25/08 |
| 2019/0291292 | A1 * | 9/2019 | Knoble | B26D 7/0641 |

* cited by examiner

METHOD AND CUTTING APPARATUS FOR CUTTING BLANK PROFILES

CROSS-REFERENCE

The present application claims priority to U.S. Provisional Patent Application No. 62/423,537, filed on Nov. 17, 2016, the entirety of which is incorporated herein by reference.

TECHNICAL FIELD

The present disclosure generally relates to the field of auto parts manufacturing. More specifically, the present disclosure relates to a method and a cutting apparatus capable of cutting blank profiles.

BACKGROUND

Auto parts are commonly build in very large manufacturing plants, using machines that are at once very large and very expensive. A typical auto parts example is shown on FIG. 1, which is a perspective view of a car side window detailing a pair of car window sweeps. An outer sweep 10 and an inner sweep 12 are located at the bottom of a window frame 14, on each side of a glass window pane 16. In order to limit as much as possible water leakage inside a door 18 under variable climatic conditions, the outer and inner sweeps 10 and 12 are made of steel-reinforced rubber profiles. Blank profiles are initially formed by extrusion. Their extremities are then cut into complex notch patterns in order for the outer and inner sweeps 10 and 12 to mate with various internal components (not shown) of the door 18.

FIG. 2 is a highly schematic top view of a conventional multi-pallet notching unit. FIG. 3 is a highly schematic side elevation view of the conventional multi-pallet notching unit of FIG. 2. Considering at once FIGS. 2 and 3, a notching unit 20 typically includes 12 pairs of cutting tools 22, six (6) on each side of the notching unit 20 (one row of cutting tools 22 is not shown on FIG. 3 in order to not hide other elements of the notching unit 20). Each cutting tool 22 is adapted to cut a different notch into ends of blank inner sweeps 24 and ends of blank outer sweeps 26. Pairs of blank inner and outer sweeps 24 and 26 are attached to pallets 30. A plurality of pallets 30 are mounted on an infinite belt 32. Each pair comprising one blank inner sweep 24 and one blank outer sweep 26 is attached by an operator 28 to a respective pallet 30 as a movement of the infinite belt 32 brings that pallet 30 at an end 34 of the notching unit 20. As first pallet $\mathbf{30}_1$ then reaches a first station 1 of six (6) stations 1-6, a first cutting tool $\mathbf{22}_1$ moves laterally inward of the notching unit 20 to cut notches (not shown) on right ends of the blank inner and outer sweeps 24 and 26 before returning to its initial, resting position. Concurrently, a second cutting tool $\mathbf{22}_2$ opposite the first cutting tool $\mathbf{22}_1$ moves laterally inward of the notching unit 20 to cut notches (not shown) on left ends of the blank inner and outer sweeps 24 and 26 before returning to its initial, resting position. The first pallet $\mathbf{30}_1$ moves forward to a second station 2 by action of the infinite belt 32. At the same time, another pallet $\mathbf{30}_2$ reaches the first station 1.

The illustrated notching unit 20 includes 12 cutting tools 22 that each are capable of moving laterally in synchrony with a movement of the infinite belt 32, for cutting up to six (6) notches at each end of the blank inner and outer sweeps 24 and 26. These movements require the notching unit 20 to include at least 13 motors (not specifically shown), one for each of the 12 moving cutting tool 22 and an additional one, usually larger, for running the infinite belt 32. Generally, these 13 motors are servo controlled motors to ensure proper synchrony of all components of the notching unit 20.

A typical notching unit such as the notching unit 20 is at once very expensive, in a large part because of the cost of its numerous servo controlled motors, and very bulky, occupying very significant floor space of an auto part manufacturing plant. A typical notching unit is actually wider than most standard transport containers and requires special means for delivery from its point of fabrication to the auto part manufacturing plant.

The operator 28 places blank inner and outer sweeps 24 and 26 on each pallet 30 that passes at the end 34 of the notching unit 20. If the operator 28 does not complete this operation in time before a given pallet 30 is moved into the first position 1, the operation of the notching unit 20 may need to be stopped, or at least slowed down, either automatically or command of the operator 28. Alternatively, the operation of the notching unit 20 may continue in the absence of one or both of the blank inner and outer sweeps 24 and 26 on the given pallet 30, which would be an inefficient use of the notching unit 20.

It is rare that a typical notching unit will be dedicated to manufacturing a unique type of car window sweeps. The various cutting tools 22 of the notching unit 20 are conventionally dismounted and replaced with other sets of cutting tools 22 whenever there is a need to manufacture car window sweeps for another car model. In fact, different pairs of car window sweeps are required for each of the four (4) doors of a typical sedan. Changing a set of up to 12 cutting tools 22 may require several hours of downtime of the notching unit 20.

Therefore, there is a need for improvements that compensate for at least some of the problems related to cost, size and maintenance needs of typical notching units.

SUMMARY

In a first aspect of the present disclosure, there is provided a cutting apparatus for cutting blank profiles. The cutting apparatus comprises a first cutting device located at a first position in the cutting apparatus, a second cutting device located at a second position, the second position being separated from the first position along a first axis of the cutting apparatus, and a third cutting device located at a third position, the third position being separated from the first position along a second axis and along a third axis of the cutting apparatus. The cutting apparatus also comprises a chariot configured to move along the third axis of the cutting apparatus and a support mounted to the chariot, the support being configured to hold a blank profile and to move along the first axis and along the second axis of the cutting apparatus.

In a second aspect of the present disclosure, there is provided a cutting apparatus for cutting blank profiles. The cutting apparatus comprises a plurality of cutting devices, a chariot and a support. A first plurality of pairs of cutting devices is located in a first plane of the cutting apparatus, each pair of the first plurality of pairs of cutting devices including a cutting device on each of opposite first and second sides of a third axis of the cutting apparatus. A second plurality of pairs of cutting devices is located in a second plane of the cutting apparatus, each pair of the second plurality of pairs of cutting devices including a cutting device on each of the first and second sides of the third axis of the cutting apparatus. The chariot is configured to move along the third axis of the cutting apparatus. The support is mounted to the chariot. The support is configured to hold a blank profile and to move along a first axis and along a second axis of the cutting apparatus.

In a third aspect of the present disclosure, there is provided a cutting apparatus for cutting blank profiles According to the present disclosure, there is also provided a cutting apparatus for cutting blank profiles. The cutting apparatus comprises a plurality of cutting devices, a chariot and a support. A first plurality of pairs of cutting devices is located in a first plane of the cutting apparatus, each pair of the first plurality of pairs of cutting devices including a cutting device on each of opposite first and second sides of a third axis of the cutting apparatus. A second plurality of pairs of cutting devices is located in a second plane of the cutting apparatus, each pair of the second plurality of pairs of cutting devices including a cutting device on each of the first and second sides of the third axis of the cutting apparatus. The chariot is configured to move between the first and second sides of the third axis of the cutting apparatus. The support is mounted to the chariot. The support is configured to hold a blank profile, to move along a first axis of the cutting apparatus towards either of the first and second sides of the third axis of the cutting apparatus, and to move along a second axis of the cutting apparatus between the first and second planes of the cutting apparatus.

In a fourth aspect, of the present disclosure, there is provided a method of cutting blank profiles. A blank profile is carried toward a first cutting device located at a first position in a cutting apparatus and the first cutting device is used to cut a first notch in the blank profile. The blank profile is carried toward a second cutting device located at a second position in the cutting apparatus, the second position being separated from the first position along a first axis of the cutting apparatus and the second cutting device i used to cut a second first notch in the blank profile. The blank profile is carried toward a third cutting device located at a third position in the cutting apparatus, the third position being separated from the first position along a second axis and along a third axis of the cutting apparatus and the third cutting device is used to cut a third notch in the blank profile.

In a fifth aspect of the present disclosure, there is provided a method of cutting blank profiles. A blank profile is positioned in a first plane. While in the first plane, the blank profile is positioned in a free space between a first pair of cutting devices, moved toward one of the cutting devices of the first pair for making a first cut at a first end of the blank profile, moved toward another one of the cutting devices of the first pair for making a second cut at a second end of the blank profile opposite from the first cut, moved in the free space between the first pair of cutting devices, positioned in a free space between a second pair of cutting devices, moved toward one of the cutting devices of the second pair for making a third cut at one of the first and second ends of the blank profile, moved toward another one of the cutting devices of the second pair for making a fourth cut at one of the first and second ends of the blank profile opposite from the third cut, and moved in the free space between the second pair of cutting devices. The blank profile is moved from the first plane to a second plane. While in the second plane, the blank profile is positioned in a free space between a third pair of cutting devices, moved toward one of the cutting devices of the third pair for making a fifth cut at one of the first and second ends of the blank profile, moved toward another one of the cutting devices of the third pair for making a sixth cut at one of the first and second ends of the blank profile opposite from the fifth cut, moved in the free space between the third pair of cutting devices, positioned in a free space between a fourth pair of cutting devices, moved toward one of the cutting devices of the fourth pair for making a seventh cut at one of the first and second ends of the blank profile, and moved toward another one of the cutting devices of the fourth pair, for making an eighth cut at one of the first and second ends of the blank profile opposite from the seventh cut.

The foregoing and other features will become more apparent upon reading of the following non-restrictive description of illustrative embodiments thereof, given by way of example only with reference to the accompanying drawings.

BRIEF DESCRIPTION OF THE DRAWINGS

Embodiments of the disclosure will be described by way of example only with reference to the accompanying drawings, in which.

Like numerals represent like features on the various drawings.

DETAILED DESCRIPTION

Figure 1:
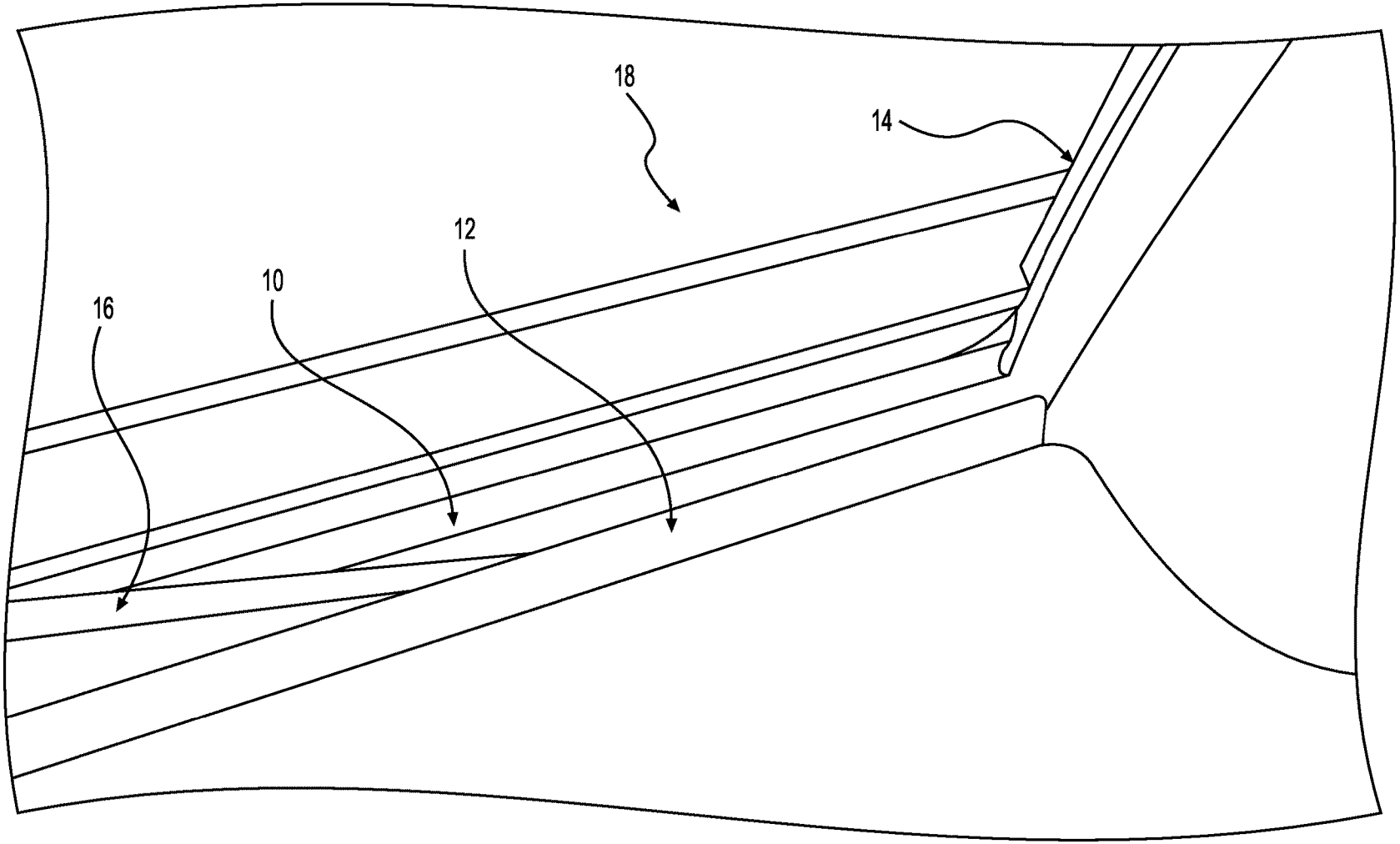
FIG. 1 (PRIOR ART)
FIG. 1 is a perspective view of a car side window detailing a pair of car window sweeps.
Figure 2:
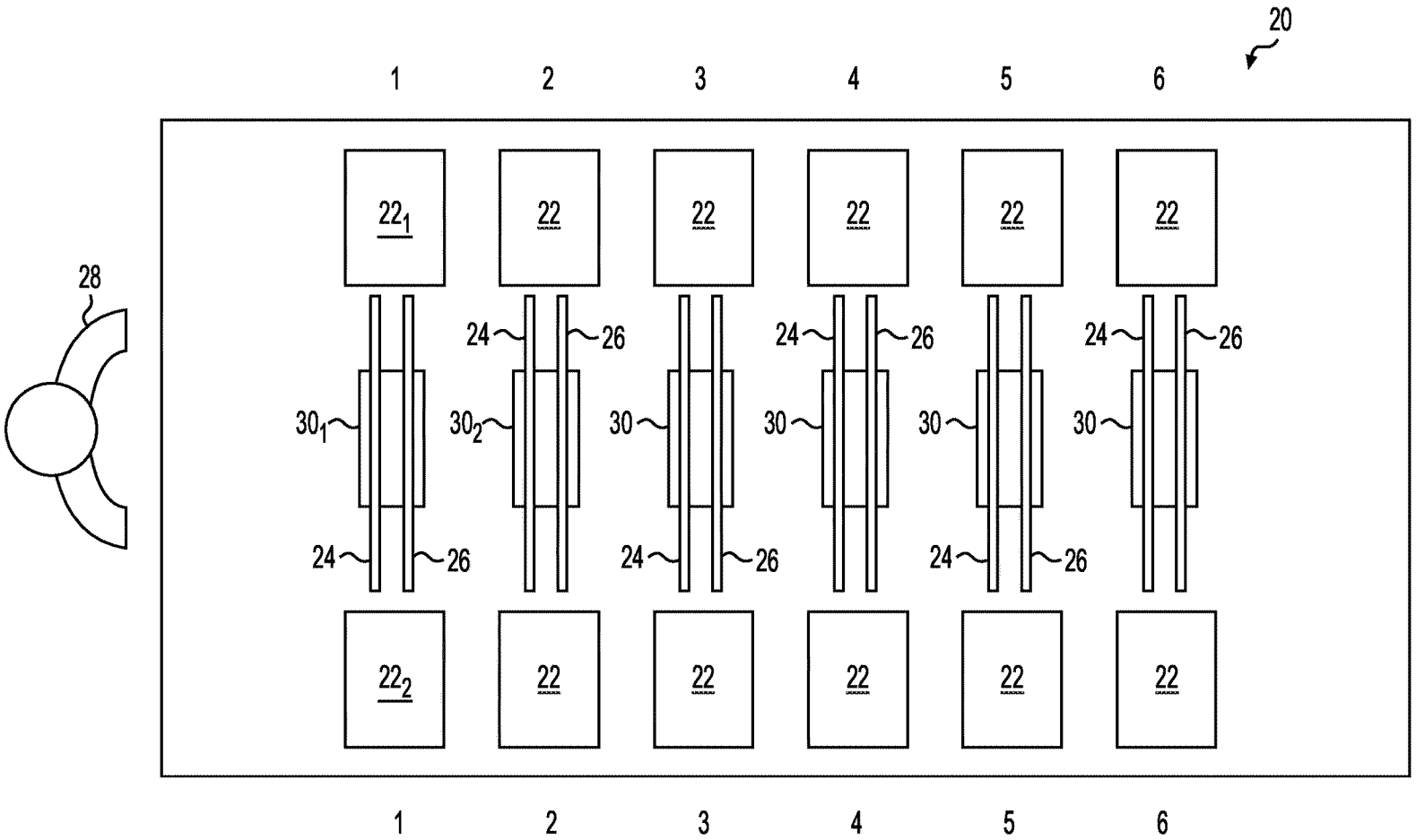
FIG. 2 (PRIOR ART)
FIG. 2 is a highly schematic top view of a conventional multi-pallet notching unit.
Figure 3:
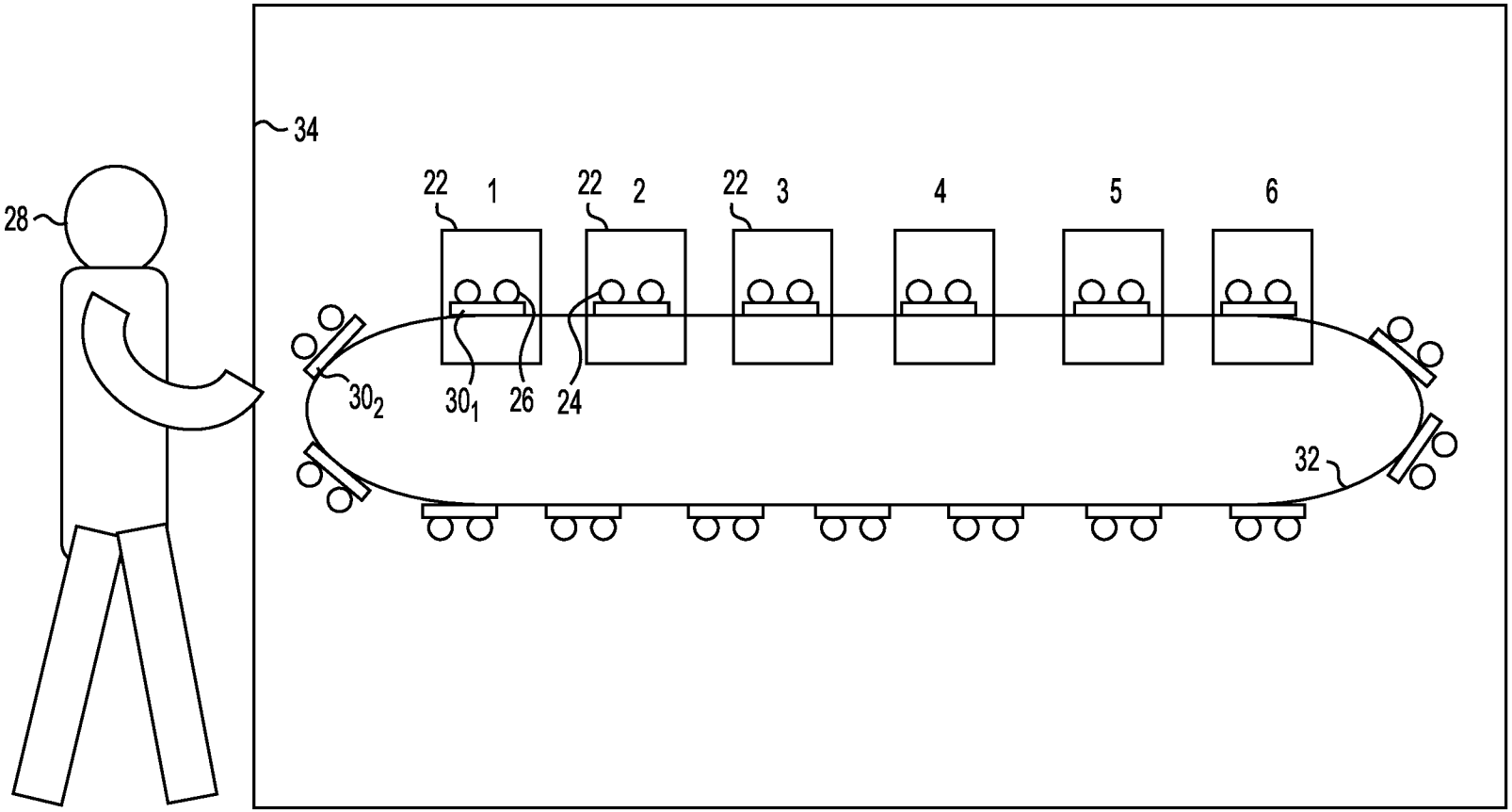
FIG. 3 (PRIOR ART)
FIG. 3 is a highly schematic side elevation view of the conventional multi-pallet notching unit of FIG. 2.

Various aspects of the present disclosure generally address one or more of the problems related to cost, size and maintenance needs of typical notching units.

Generally speaking the present technology addresses at least some of the disadvantages of conventional multi-pallet notching units by providing a cutting apparatus having cutting devices placed in fixed positions and distributed over two planes on either sides of a first axis. The cutting apparatus has a chariot that can move along one axis. A support, mounted on the chariot, holds one or more blank profiles. The support can move in relation to the chariot along two other axes so that the one or more blank profiles can be carried in three dimensions (3D) toward the various cutting devices.

The disclosed cutting apparatus may be used as a notching unit adapted to cut a plurality of configured notches on both ends of elongated profiles. Though the foregoing has been discussing the field of auto parts manufacturing and the specific example of car window sweeps, the present disclosure is not limited to such field and to the manufacturing of such auto parts. The present technology can be adapted to the fabrication of other car parts as well as to the fabrication of parts for other uses than the automotive industry. As a non-limitative example, the present technology may be used in the construction industry for cutting metal profiles or plastic profiles, for example CPV profiles, for the manufacture of window frames.

The following terminology is used throughout the present disclosure:

- Cutting apparatus: a machine adapted to make cuts, for example notches, at each extremity of a profile to fabricate a finished product such as, for example, a car window sweep.
- Profile: a generally elongated extruded element that can be processed by the cutting apparatus to form a desired finished product.
- Blank profile: this term generally designates a profile having not yet been cut by the cutting apparatus; however, for convenience purposes, this term may be used in the present disclosure to designate a profile in various stages of its processing in the cutting apparatus.
- Cutting device: a device adapted to make a cut, for example a notch, onto an end of a profile inserted through an opening of the cutting device, the size and shape of the cut being configurable; the cutting device may include an electric, hydraulic or pneumatic motor, for example a servo motor, that is controlled by a controller or that is triggered by the insertion of the end of the profile into the opening.
- Chariot: a component of the apparatus capable of moving along an axis of the apparatus by action of a motor, for example a servo motor.
- Support: a component of the cutting apparatus capable of holding, either directly or indirectly, one or more blank profiles being processed by the cutting apparatus, the support moving by action of a motor, for example a servo motor.
- Servo motor: a motor, for example an electric motor, controlled by a controller so that a plurality of servo motors can operate synchronously.
- Sub-frame: a part of a chassis of the cutting apparatus that is detachable from another sub-frame.
- Pallet: a small platform for holding one or more blank profiles, detachable from a support.
- Control panel: enclosure for a controller of a machine or apparatus, including without limitation for controlling cutting devices and servo motors.

Figure 4:
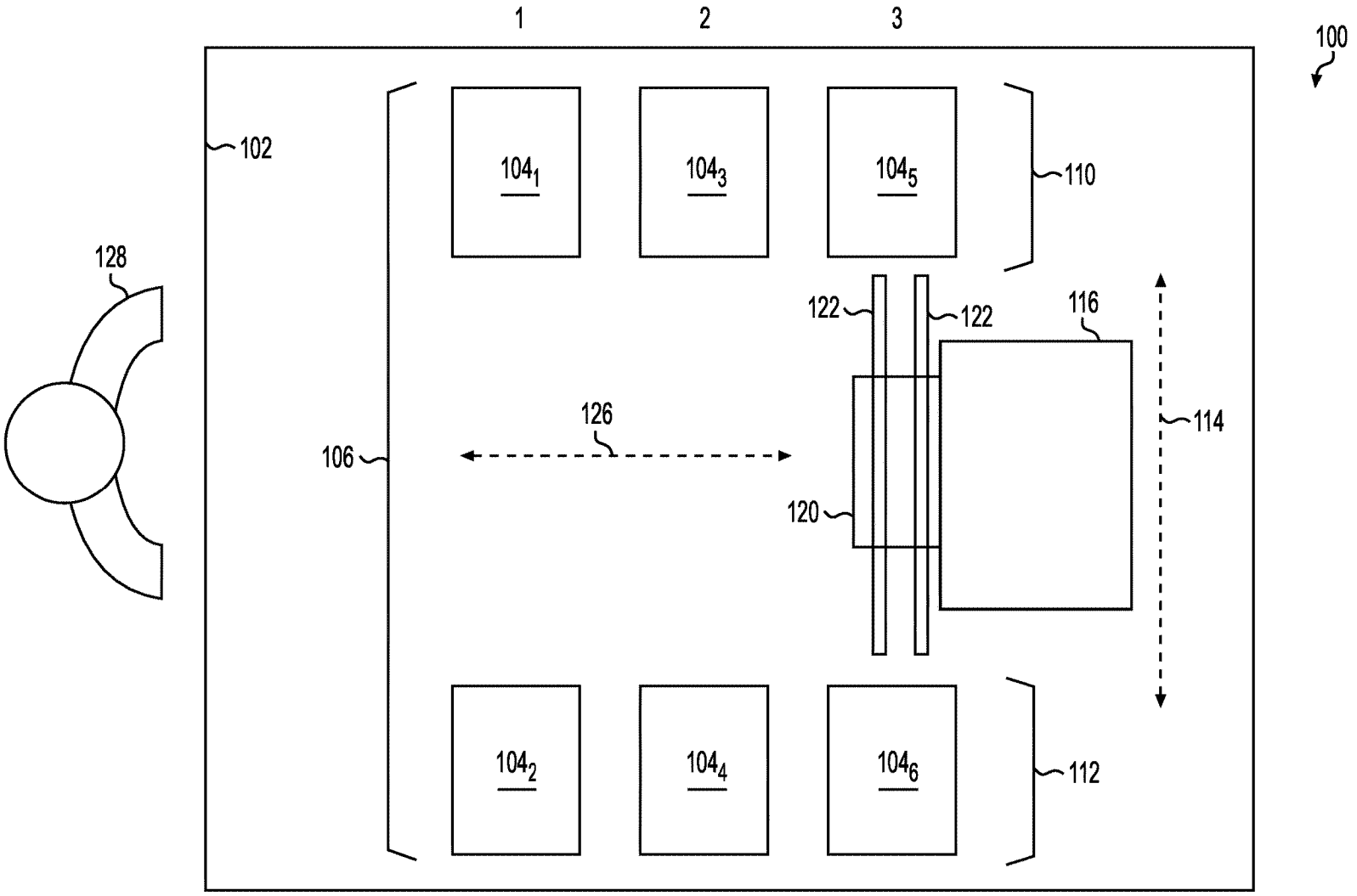
FIG. 4 is a highly schematic top view of a cutting apparatus according to an embodiment.
Figure 5:
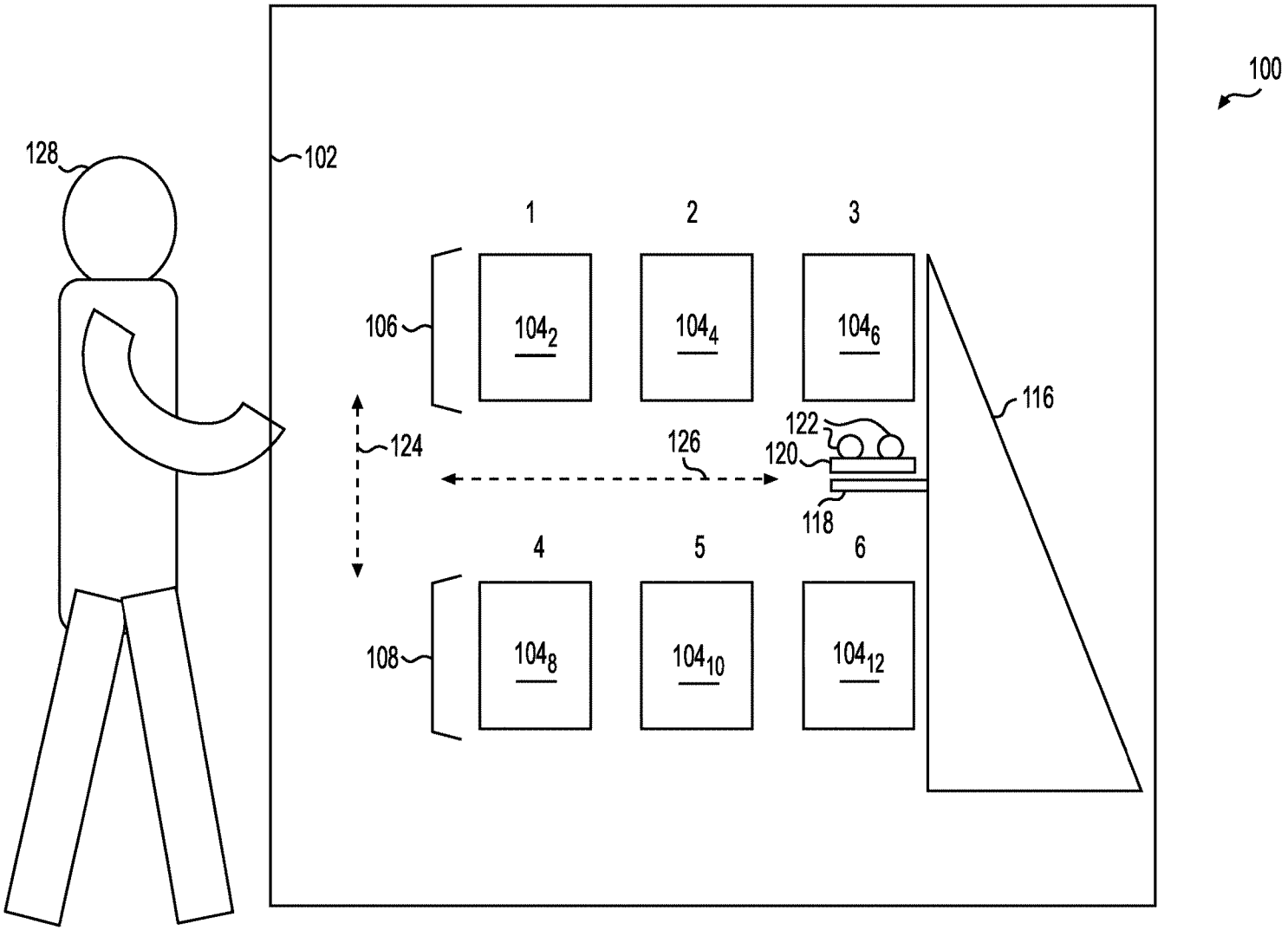
FIG. 5 is a highly schematic side elevation view of the cutting apparatus of FIG. 4.

Referring now to the drawings, FIG. 4 is a highly schematic top view of a cutting apparatus according to an embodiment. FIG. 5 is a highly schematic side elevation view of the cutting apparatus of FIG. 4. Referring at once to FIGS. 4 and 5, a cutting apparatus 100 is configured to cut a variety of cut, such as notches, on both ends of blank profiles. Without limitation, the blank profiles may for example comprise elongated metal-reinforced rubber extrusions being cut for the manufacture of car window sweeps.

The cutting apparatus 100 has frame 102 defining a 3D enclosure over a first axis 114, a second axis 124 and a third axis 126. The frame 102 encloses a plurality of cutting devices 104. The cutting devices 104 are distributed over two (2) planes 106, 108, each plane 106 and 108 including a plurality pairs of cutting devices 104, each pair including a cutting device 104 on each of opposite sides 110, 112 of the third axis 126 of the cutting apparatus 100. A chariot 116 is adapted to move along the third axis 126. A support 118 is mounted to the chariot 116. The support 118 holds an optional pallet 120 that, in turn, holds a blank profile 122. The support 118 may include a manually operable latch, one or more screwable knobs, magnetic or pneumatic quick connects (not shown) for quick mounting and dismounting the pallet 120. The support 118, with or without the pallet 120, is adapted to hold at least one blank profile 122, or two (2) blank profiles 122 as shown on FIGS. 4 and 5. The support 118 is movable in relation to the chariot 116 so that it may move along the first axis 114 of the cutting apparatus 100, towards either of the sides 110 and 112, and along the second axis 124 of the apparatus 100, towards either of the planes 106 and 108.

Without limiting the present disclosure, operation of the cutting apparatus 100 may use servo motors (not shown) controlled by a controller (not shown) for moving the chariot 116 and the support 118. One such servo motor may be used for moving the chariot 116 along the third axis 126. Two (2) servo motors may be used to move the support 118, one to move the support 118 along the first axis 114 and another one to move the support 118 along the second axis 124. Use of other mechanisms to move the chariot 116 and the support 118 is also contemplated.

Each of the cutting devices 104 may be configured to cut a notch at an end of the blank profiles 122 when the ends of the blank profiles 122 are inserted into the cutting devices 104. Optionally, depending on the needs of the application, each cutting device 104 located on a same side 110 or 112 may be adapted to cut a different notch at the end of a given blank profile 122.

As shown on FIGS. 4 and 5, considering the position of an operator 128, the plane 106 is an upper plane located above the plane 108, which is therefore a lower plane, the side 110 is a left side while the side 112 is a right side (only the upper plane 106 is visible on FIG. 4, only the right side is visible on FIG. 5). The first and third axes 114 and 126 are horizontal axes and the second axis 124 is a vertical axis. Consequently, the chariot 116 is adapted to move horizontally within the cutting apparatus 100 while the support 118 moves up and down along the second axis 124 and left to right along the first axis 114.

Other configurations may be contemplated. In a first alternative configuration of the cutting apparatus 100, the chariot 116 may be configured to move up and down along between two (2) vertical planes, the third axis 126, becoming a vertical axis, the support 118 moving between the various cutting devices 104 over the first and second axes 114 and 124 that both become horizontal axes. This first alternative configuration may be represented by visualizing FIG. 4 as a side elevation view of the cutting apparatus 100. In a second alternative configuration, the chariot 116 may be configured to move along a horizontal third axis 126 between two (2) vertical planes, the support 118 moving over a second horizontal axis 124 between the two (2) vertical planes and over a first vertical axis 114 between the cutting devices 104 located on a same side of one of the vertical planes. This second alternative configuration may be represented by visualizing FIG. 5 as a side elevation view of the cutting apparatus 100, in which case the operator 128 as shown would be located on top of the frame 102.

In operation, referring again to FIGS. 4 and 5, cutting a blank profile 122 may be effected by the following operations, some of which are optional and some of which may take place in various order:

a) the blank profile 122 is received on the support 118, optionally on the pallet 120, from the operator 128, at a loading position (shown in a later Figure);

b) the blank profile 122 is positioned within a first plane, for example in plane 106;

c) while the blank profile 122 is in the first plane:

i. the blank profile 122 is positioned in a free space between a first pair of cutting devices, for example within a position 1 including a first pair of cutting devices $\mathbf{104}_1$ and $\mathbf{104}_2$, ii. the blank profile 122 is moved toward the cutting device $\mathbf{104}_1$, iii. a first cut is made by the cutting device $\mathbf{104}_1$ at a first end of the blank profile 122, iv. the blank profile 122 is moved toward the cutting device $\mathbf{104}_2$, v. a second cut is made by the cutting device $\mathbf{104}_2$ at a second end of the blank profile 122 opposite from the first cut, vi. the blank profile 122 returns to the free space between the first pair of cutting devices $\mathbf{104}_1$ and $\mathbf{104}_2$, vii. the blank profile 122 is positioned in a free space between a second pair of cutting devices, for example within a position 2 including a second pair of cutting devices $\mathbf{104}_3$ and $\mathbf{104}_4$, viii. the blank profile 122 is moved toward the cutting device $\mathbf{104}_3$, ix. a third cut is made by the cutting device $\mathbf{104}_3$ at the first end of the blank profile 122, x. the blank profile 122 is moved toward the cutting device $\mathbf{104}_4$, xi. a fourth cut is made by the cutting device $\mathbf{104}_4$ at the second end of the blank profile 122, and xii. the blank profile 122 returns to the free space between the second pair of cutting devices $\mathbf{104}_3$ and $\mathbf{104}_4$;

d) when operations are completed within the first plane, the blank profile 122 is moved from the first plane to a second plane;

e) while the blank profile is in the second plane:

xiii. the blank profile 122 is positioned in a free space between a third pair of cutting devices, for example within a position 4 including a third pair of cutting devices that includes a cutting device $\mathbf{104}_8$ as well as an opposite cutting device (not shown, located in the lower plane 108, on the left side 110), xiv. the blank profile 122 is moved toward the cutting device opposite from the cutting device $\mathbf{104}_8$, xv. a fifth cut is made by the cutting device opposite from the cutting device $\mathbf{104}_8$ at the first end of the blank profile 122, xvi. the blank profile 122 is moved toward the cutting device $\mathbf{104}_{10}$, xvii. a sixth cut is made by the cutting device $\mathbf{104}_{10}$ at the second end of the blank profile 122, xviii. the blank profile 122 returns to the free space between the third pair of cutting devices, xix. the blank profile 122 is positioned in a free space between a fourth pair of cutting devices, for example within a position 5 including a fourth pair of cutting devices that includes a cutting device $\mathbf{104}_{10}$ as well as an opposite cutting device xx. the blank profile 122 is moved toward the cutting device opposite from the cutting device $\mathbf{104}_{10}$, xxi. a seventh cut is made by the cutting device opposite from the cutting device $\mathbf{104}_{10}$ at the first end of the blank profile 122, xxii. the blank profile 122 is moved toward the cutting device $\mathbf{104}_{10}$, xxiii. an eighth cut is made by the cutting device $\mathbf{104}_{10}$ at the second end of the blank profile 122, and xxiv. the blank profile 122 returns to the free space between the fourth pair of cutting devices;

f) the blank profile is returned to the loading position.

Without limitation, the above sequence may be applied to cut notches into blank profiles to fabricate car window sweeps. In the above sequence, the expression "blank profile" continues being used to designate a profile having been subject to one or more cutting operations. Though such a profile may not actually remain "blank" throughout the process, this term is used, as the profile goes through the process, in order to simplify the present disclosure.

Variations of the above sequence are contemplated. For example, if 12 notches are to be cut in the blank profile 122, the above sequence may be extended by bringing the blank profile within positions 3 and 6 shown on FIGS. 4 and 5, where the cutting devices $\mathbf{104}_5$, $\mathbf{104}_6$, $\mathbf{104}_{12}$ and another cutting device opposite from the cutting device $\mathbf{104}_{12}$ (not shown, located in the lower plane 108, on the left side 110) also cut notches in the ends of the blank profile 122.

The above sequence may be modified, for example by moving the blank profile 122 between positions in a different order, for example by passing through positions 1, 4, 5, 2, 3 and then 6, or in any other order.

Depending on adaptations made on the cutting devices 104, each of the first, third, fifth and seventh cuts may be a different cut, for example a different notch, and/or each of the second, fourth, sixth and eighth cuts may also be a different cut, for example a different notch.

Using the cutting apparatus 100 having the configuration as shown on FIGS. 4 and 5, the first and second planes extend along a horizontal axis. Using one of the alternative configurations described hereinabove, the first and second planes may extend along a vertical axis and moving the blank profile from the first plane to a second plane may either comprises moving the blank profile horizontally or vertically.

Figure 6:
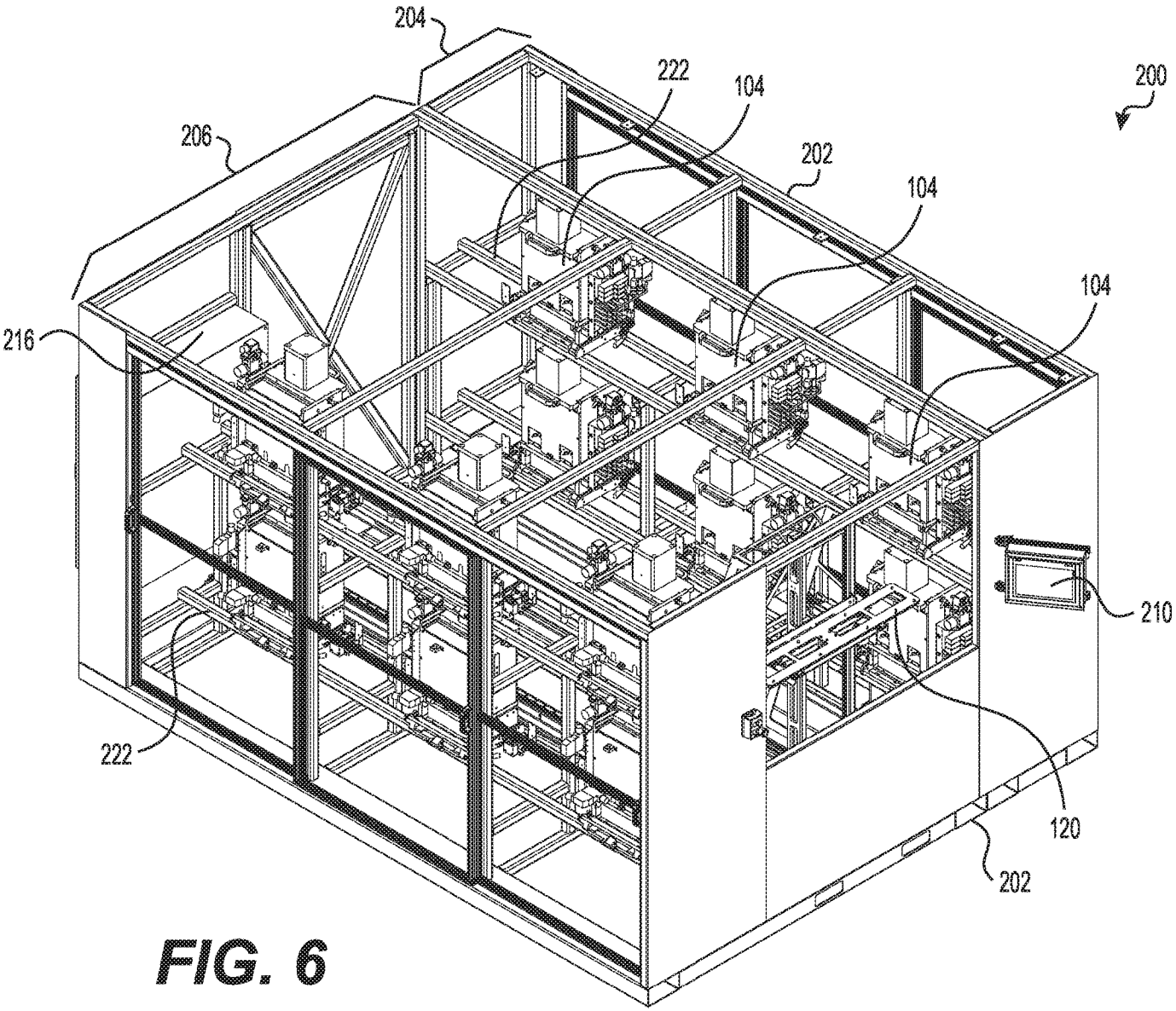
FIG. 6 is a top perspective view of a cutting apparatus according to another embodiment.
Figure 7:
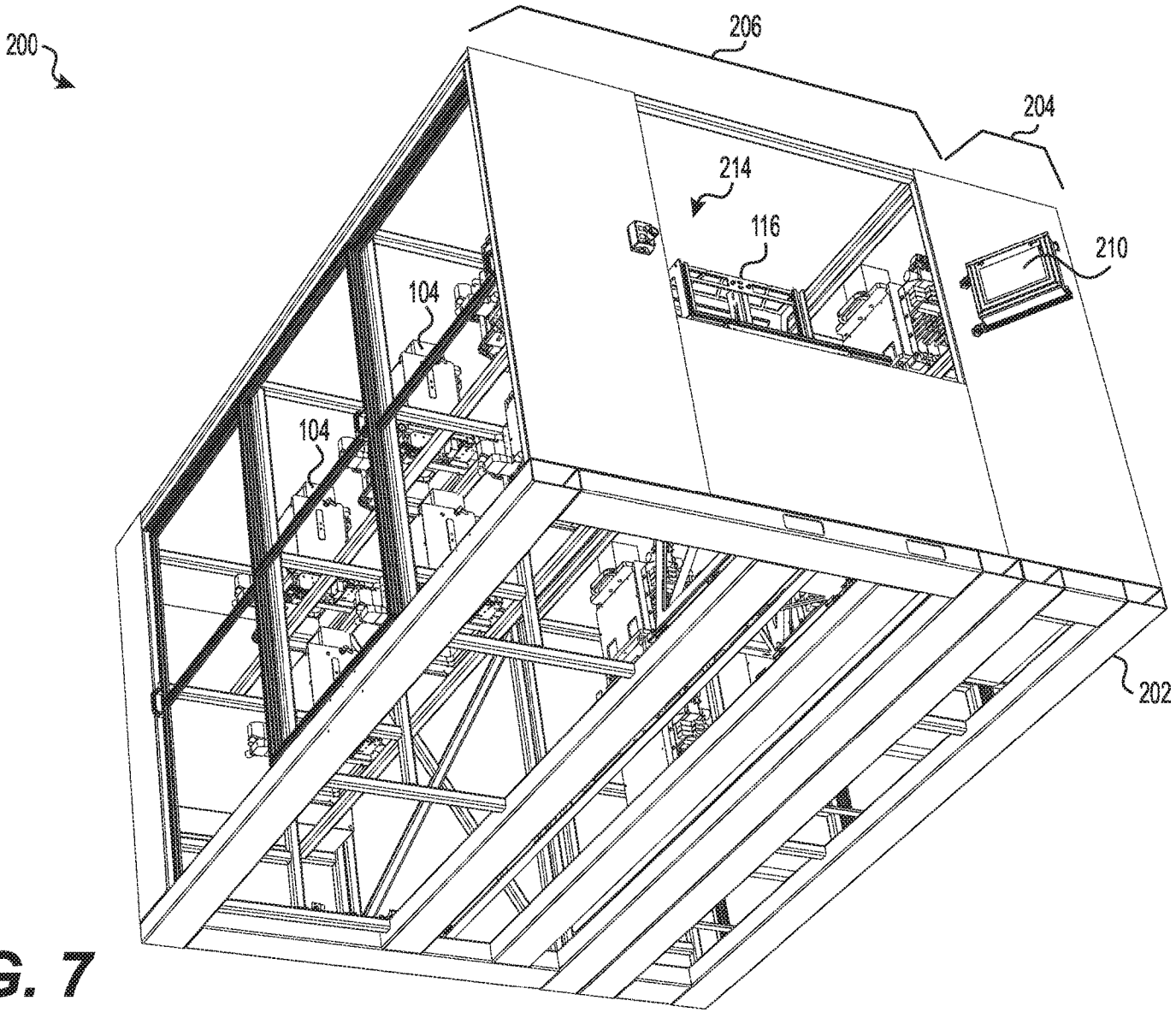
FIG. 7 is a bottom perspective view of the cutting apparatus of FIG. 6.
Figure 8:
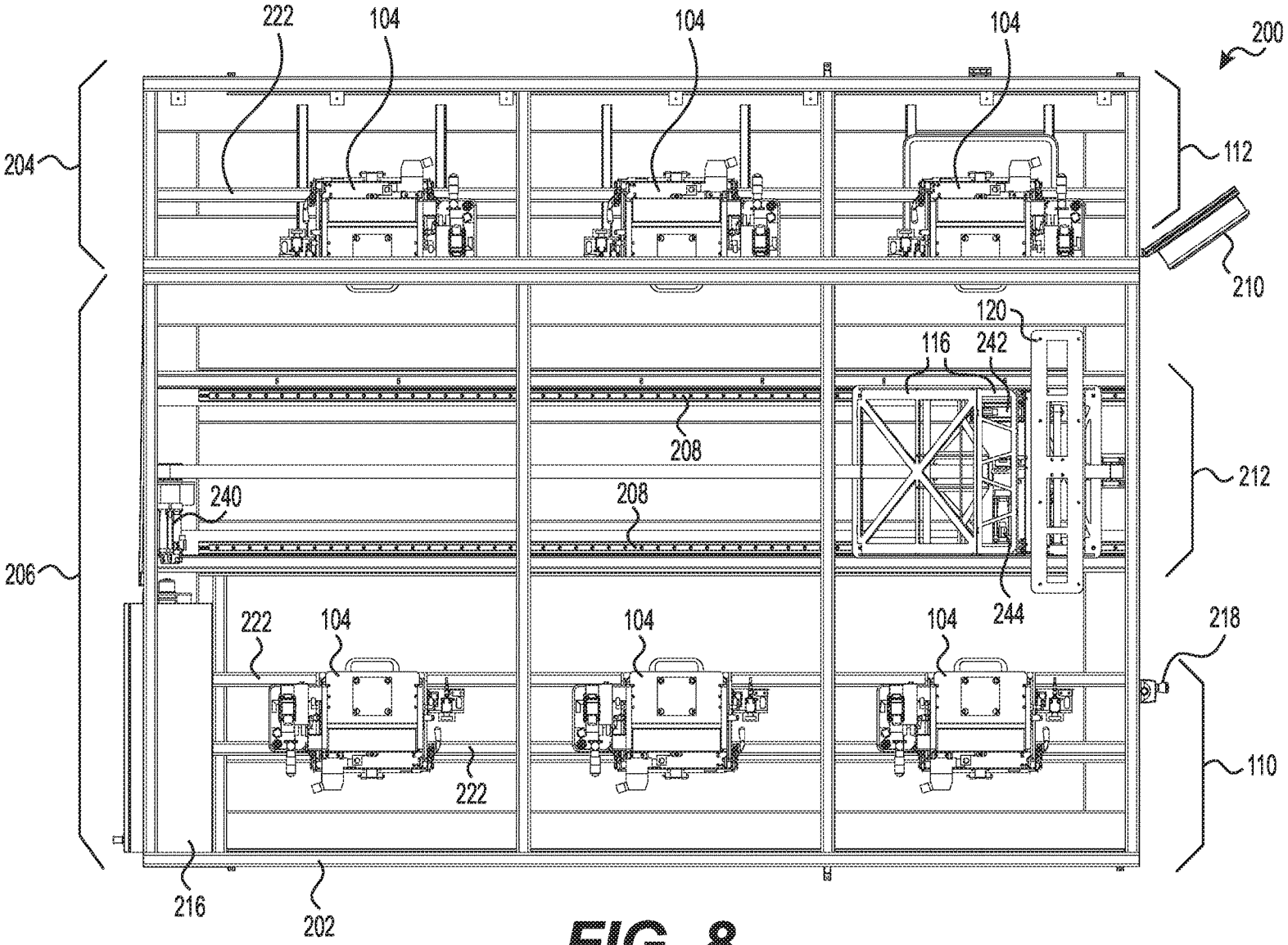
FIG. 8 is a top plan view of the cutting apparatus of FIG. 6.
Figure 9:
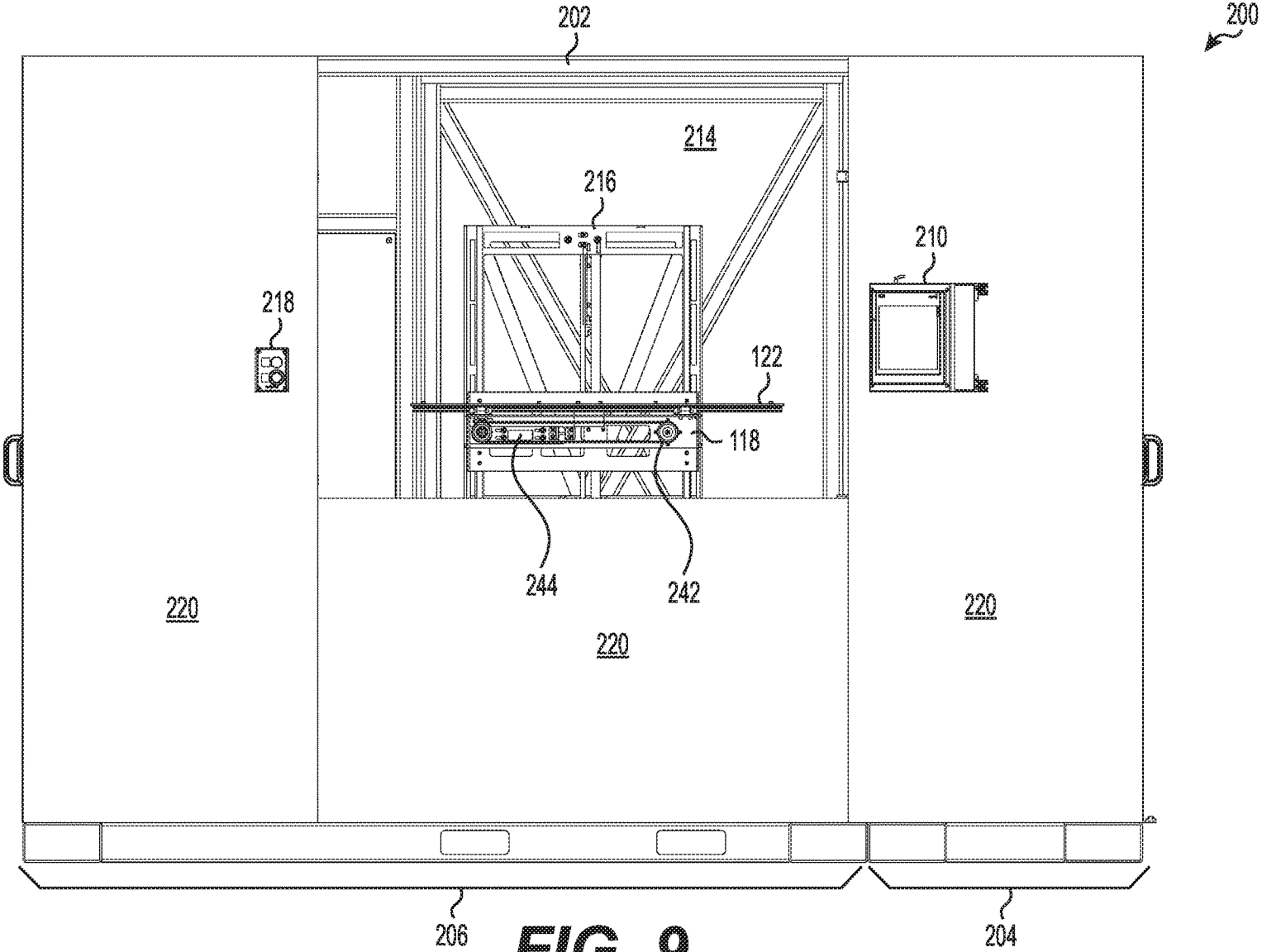
FIG. 9 is a front elevation view of the cutting apparatus of FIG. 6.
Figure 10:
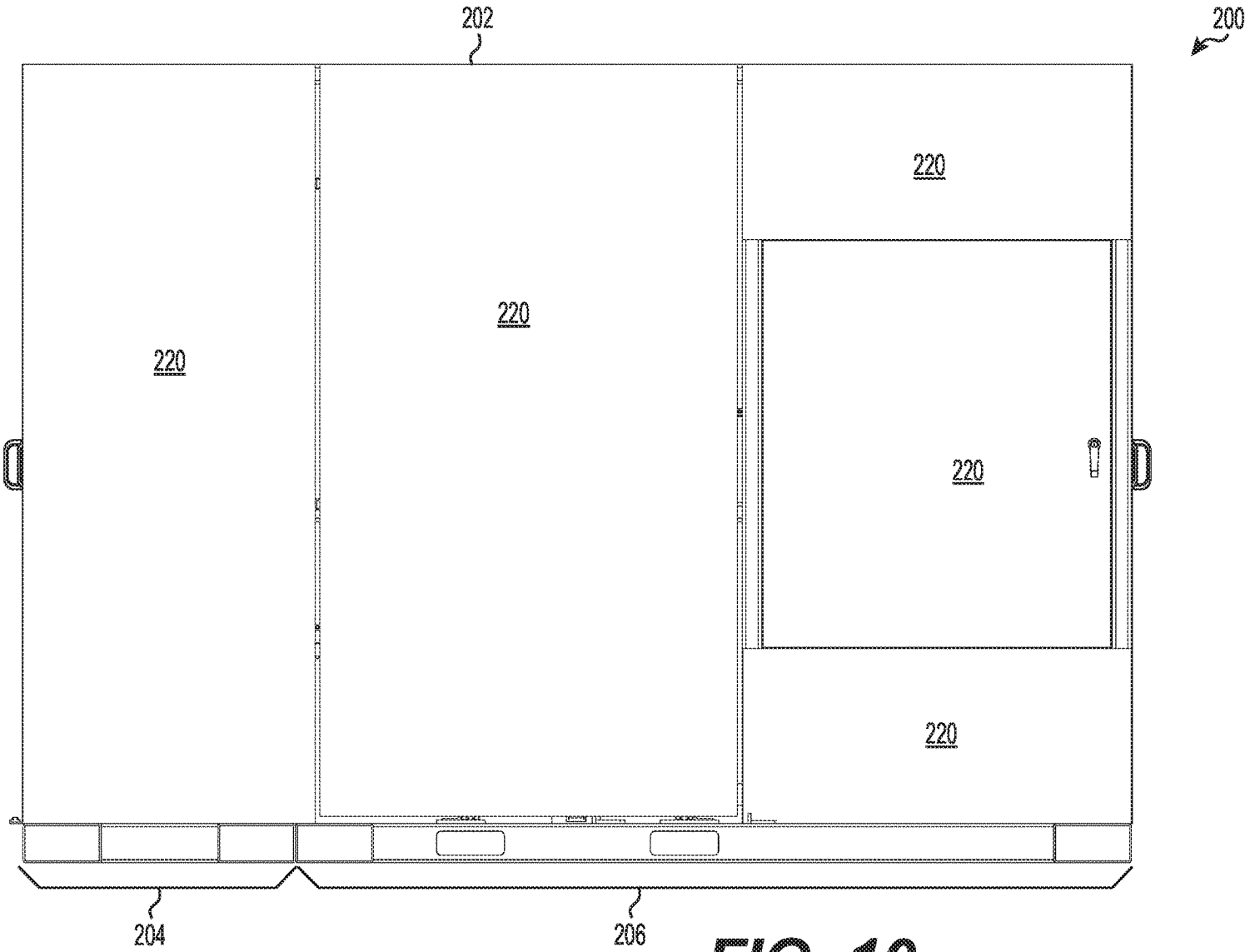
FIG. 10 is a front elevation view of the cutting apparatus of FIG. 6.
Figure 11:
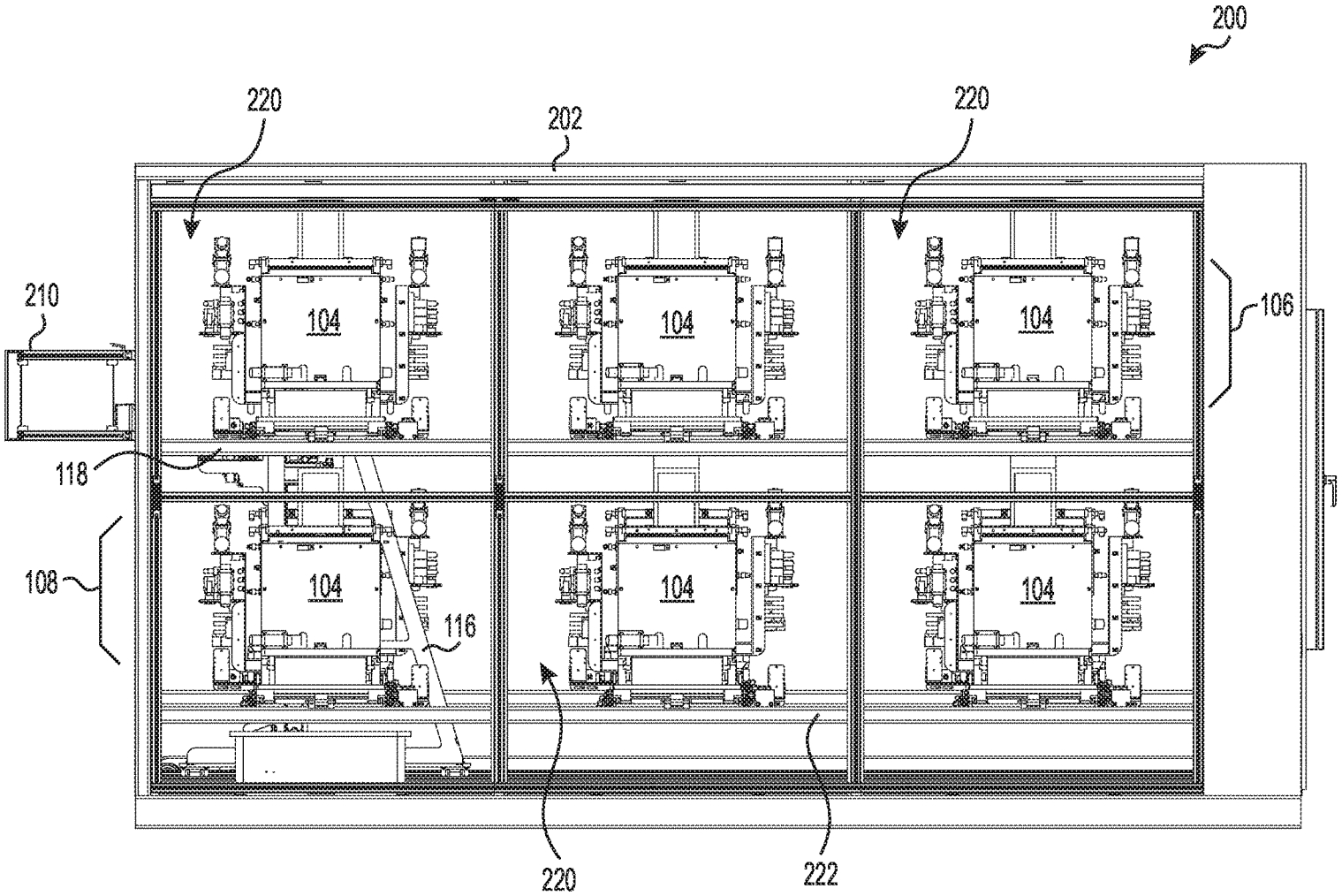
FIG. 11 is a side elevation view of the cutting apparatus of FIG. 6.
Figure 12:
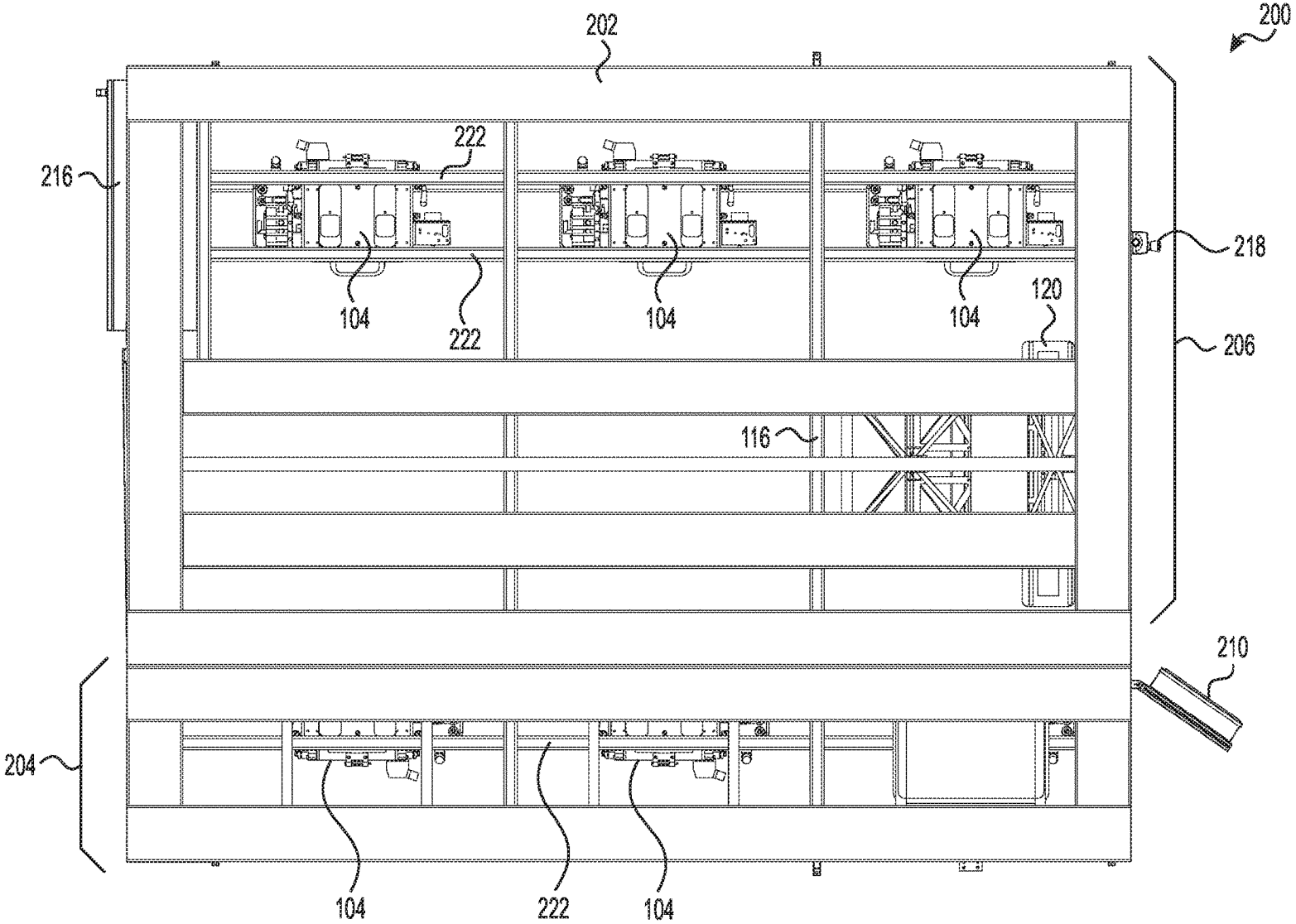
FIG. 12 is a bottom plan view of the cutting apparatus of FIG. 6.

Having described hereinabove the fundamentals of the present technology, a more detailed embodiment will now be introduced. FIG. 6 is a top perspective view of a cutting apparatus according to another embodiment. FIG. 7 is a bottom perspective view of the cutting apparatus of FIG. 6. FIG. 8 is a top plan view of the cutting apparatus of FIG. 6. FIG. 9 is a front elevation view of the cutting apparatus of FIG. 6. FIG. 10 is a front elevation view of the cutting apparatus of FIG. 6. FIG. 11 is a side elevation view of the cutting apparatus of FIG. 6. FIG. 12 is a bottom plan view of the cutting apparatus of FIG. 6. Referring at once to FIGS. 6-12, a cutting apparatus 200 may, without limiting the present disclosure, be applied to cut notches into blank profiles to fabricate car window sweeps.

The cutting apparatus 200 includes a chariot 116 mounted on horizontal rails 208 and adapted to move along a third axis 126 (reference 126 being shown on earlier Figures) that extends horizontally within a frame 202 of the cutting apparatus 200. The cutting apparatus 200 also includes a plurality of cutting devices 104 located in an upper plane 106 and in a lower plane 108. The planes 106 and 108 are defined by the location of a number of beams 222 that support the cutting devices 104. A support 118 mounted to the chariot 116 and holding a pallet 120 is movable in relation to the chariot 116 along a horizontal first axis 114 toward sides 110 and 112 of the cutting apparatus 200, and along a vertical second axis 124 toward either of the upper and lower planes 106 and 108 of the cutting apparatus 200.

The cutting apparatus 200 of FIGS. 6-12 includes 12 cutting devices 104 split into four (4) groups each including three (3) cutting devices 104. This configuration is illustrative and does not limit the present disclosure. For example, each group could for example include two (2) or four (4) cutting devices 104. Groups of cutting devices 104 may differ in numbers between the upper and lower planes 106 and 108, or between the sides 110 and 112, for example when an application requires a number of cuts that is not an integer multiple of four (4). A cutting apparatus having more than two (2) horizontal planes is also contemplated.

The cutting apparatus 200 comprises a frame 202 that contains major components including the cutting devices 104, the chariot 116, the support 118 and a control panel 216. The control panel 216 is configured to control a synchronous operation of the cutting devices 104 with an operation of the servo motors for the chariot 116 and for the support 118. As illustrated on FIG. 8, a servo motor 240 is operative to move the chariot 116 longitudinally along the rails 208. FIGS. 8 and 9 also show a servo motor 242 operative to move the support 118 laterally between rows of cutting devices 104 and a servo motor 244 operative to move the support 118 vertically between upper and lower planes of the cutting apparatus 200. The frame 202 may include a plurality of protective panels 220, some of which may be transparent, provided for safety purposes. A display 210, which may be a touch-sensitive display or may be combined with a keyboard (not shown), and an emergency switch 218, both of which being connected to the control panel 216, are mounted on external faces of the frame 202, next to an operator position 212 that, in turn, faces a window 214 practiced in one of the protective panels 220.

The operator may install one or two blank profiles 122 directly on the support 118 or, optionally, on the pallet 120 placed on the support 118. In some configurations, the pallet 120 may be detachable from the support 118 so that the operator may attach blank profiles 122 on one pallet 120 while other blank profiles 122 tied to another pallet 120 are being processed by the cutting apparatus 200. Using the display 210 or a keyboard, the operator may select a height of the support 118 at a loading position within the window 214.

The frame 202 may be divided into sub-frames 204 and 206. One sub-frame 206 includes the chariot 116 mounted on the rails 208, the support 118, the control panel 216 and all cutting devices 104 located on one side 110 of the cutting apparatus 200. Another sub-frame 204 includes all cutting devices 104 located on the other side 112 of the cutting apparatus 200. The sub-frames 204 and 206 are detachable. Though wider than the sub-frame 204, the sub-frame 206 may still fit within a standard-size container for ease of transportation. Quick-connect electrical links (not shown) may be provided between the sub-frames 204 and 206 to facilitate connection and disconnection between the cutting devices 104 of the sub-frame 204 and the control panel 216.

Figure 13:
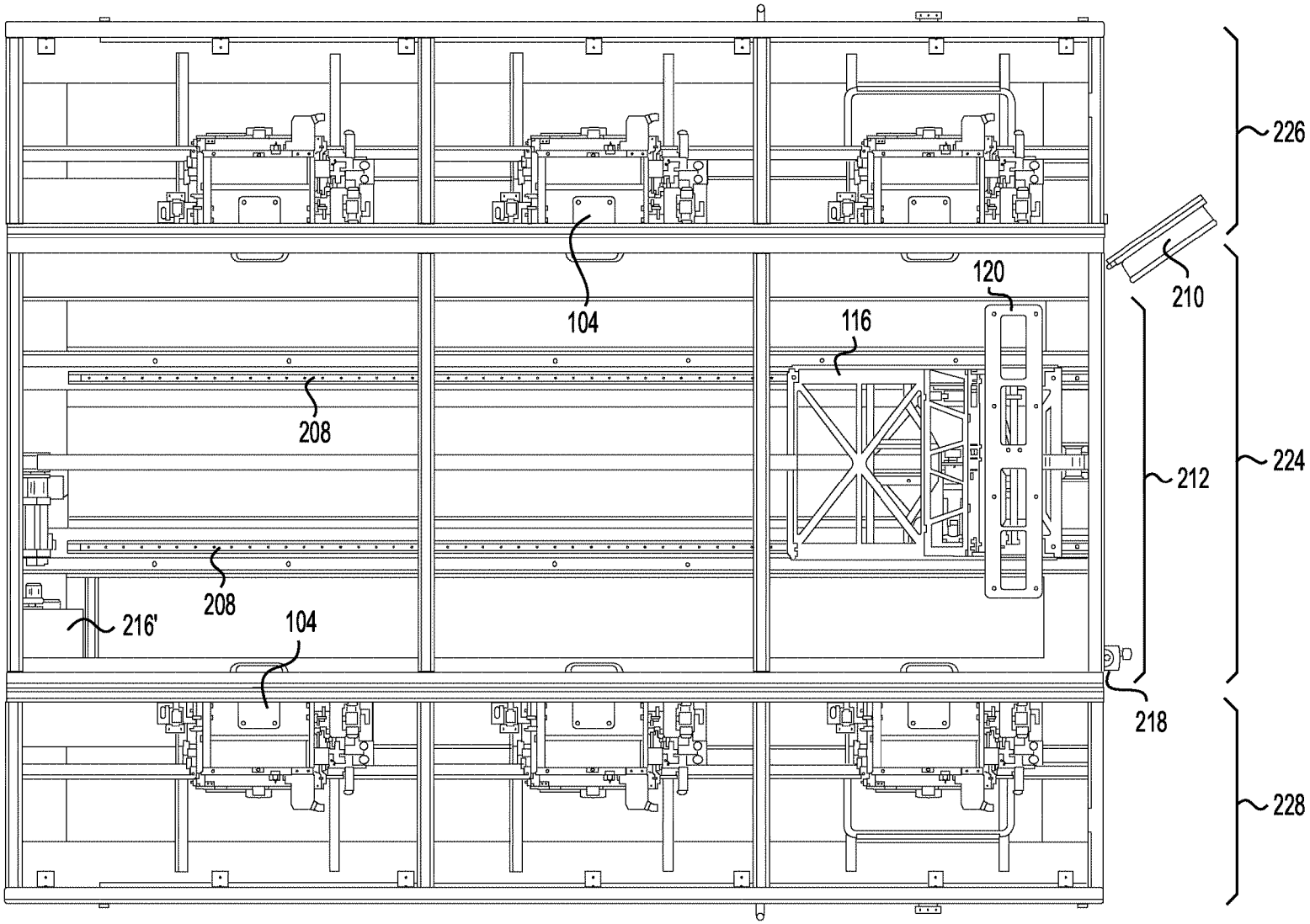
FIG. 13 is a top plan view of a first variant of the cutting apparatus of FIG. 6.

Additional variants of the cutting apparatus 200 are provided to facilitate its reconfiguration. For example, FIG. 13 is a top plan view of a first variant of the cutting apparatus of FIG. 6. In this variant, the cutting apparatus 200 comprises three (3) sub-frames, in which a central sub-frame 224 includes the chariot 116, the support 118, the rails 208 and a resized control panel 216'. The display 210 and the emergency switch 218 may be brought slightly closer to the operator position 212 so that they are mounted on the central sub-frame 224. Two side sub-frames 226 and 228 each include the cutting devices 104 of a respective side of the cutting apparatus 200. Quick-connect electrical links (not shown) may be provided between the sub-frames 224, 226 and 228 to facilitate their connection and disconnection. While the cutting apparatus 200 is in operation with a given set of cutting devices 104 mounted in the side sub-frames 226 and 228, a set of replacement cutting devices (not shown) may be installed in replacement sub-frames (not shown) in order to prepare for a re-configuration of the cutting apparatus 200 to the needs of another application. Upon reconfiguration, the sub-frames 226 and 228 and the cutting devices 104 that they contain are disconnected from the central sub-frame 224 and moved away, the replacement sub-frames with their replacement cutting devices being then attached to the central sub-frame 224.

Figure 14:
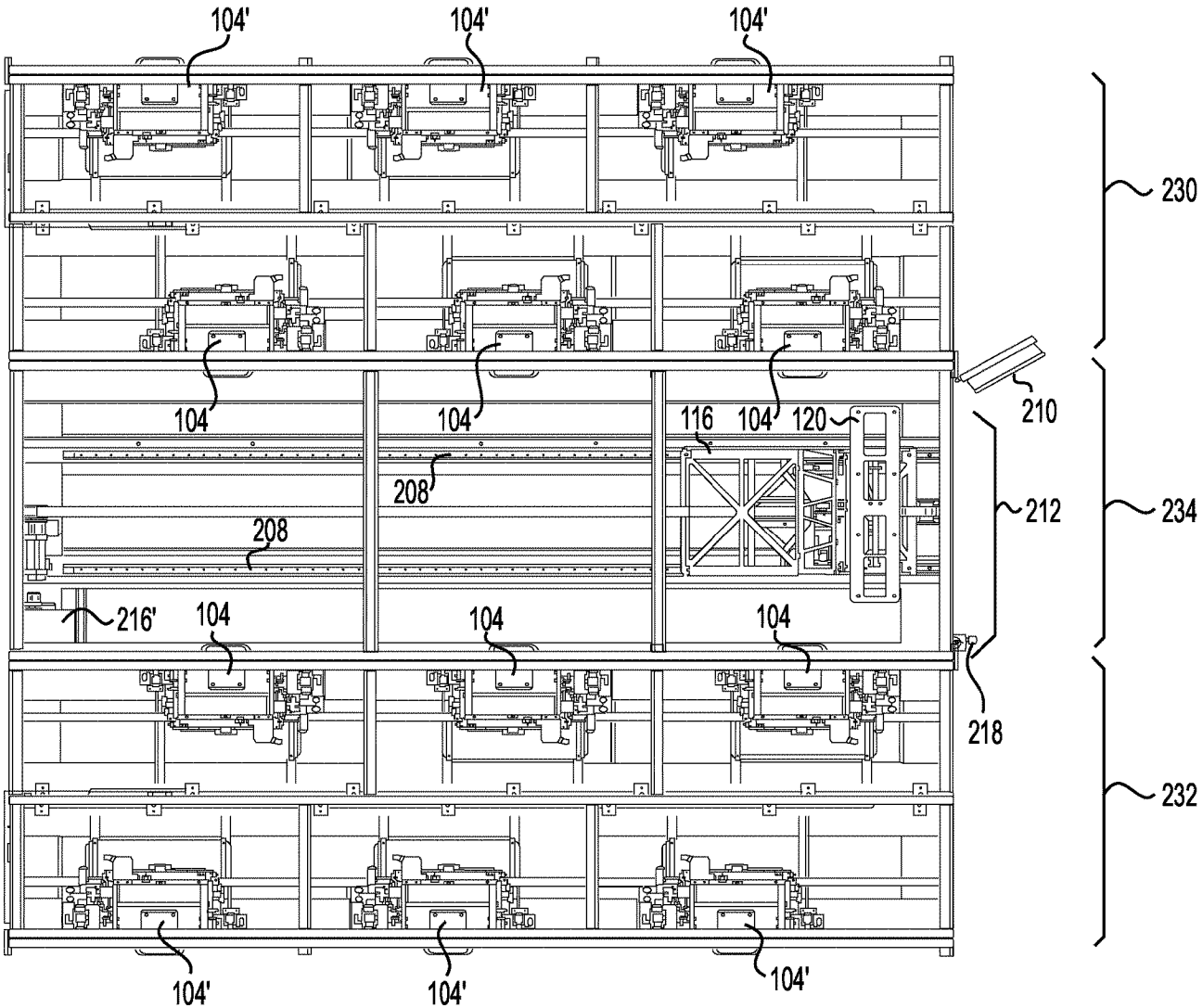
FIG. 14 is a top plan view of a second variant of the cutting apparatus of FIG. 6.

FIG. 14 is a top plan view of a second variant of the cutting apparatus of FIG. 6. In this second variant, the central sub-frame 224 may be similar to the central sub-frame 224 of FIG. 13. Side sub-frames 230 and 232 each include, on one side, sets of cutting devices 104 that are in an operating position of the cutting apparatus 200. Each of the side-sub-frames 230 and 232 further includes, on another side opposite from their operating side, a set of replacement cutting devices 104' being readied for operation. Reconfiguring the cutting apparatus 200 may be performed by disconnecting quick connect electrical links between the sub-frames 230 and 232 and the central sub-frame 224, rotating the sub-frames 230 and 232 about their vertical axis by 180 degrees to bring the replacing cutting devices 104' in proper position for operation of the cutting apparatus 200, and reconnecting the quick connect electrical links.

Figure 15:
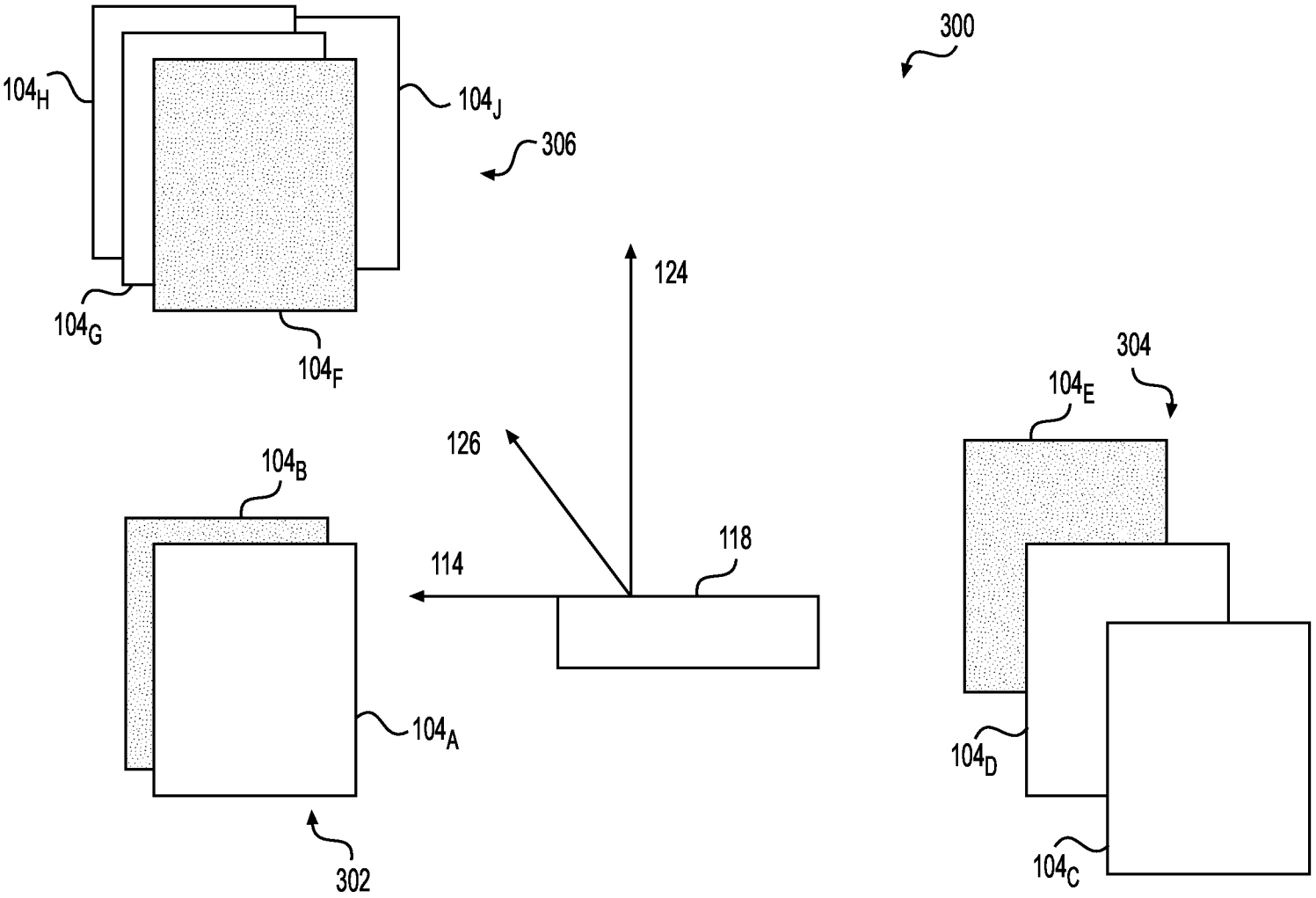
FIG. 15 is a schematic view of a positioning arrangement of cutting devices in a cutting apparatus according to an embodiment.

The foregoing describes embodiments of the present technology in which the cutting devices 104 are assembled in pairs distributed over two (2) planes 106, 108 and over two (2) sides 110, 112 within the cutting apparatus 100. However, the present technology is not limited to a particular distribution of cutting devices within a 3D space of a cutting apparatus. FIG. 15 is a schematic view of a positioning arrangement of cutting devices in a cutting apparatus according to an embodiment. Cutting devices 104 are distributed at various positions over a 3D space defined by the first axis 114, the second axis 124 and the third axis 126 within a cutting apparatus 300. As shown, the support 118 can move over the three (3) axes 114, 124, 126, carrying a pallet 120 and a blank profile 122 mounted thereon. In the example of FIG. 15, the cutting devices 104 form three (3) groups, including a first group 302, a second group 304 and a third group 306 of cutting devices 104. Within each group, the cutting devices 104 have positions that are generally distributed along the third axis 126. The first group 302 includes two (2) cutting devices $\mathbf{104}_A$ and $\mathbf{104}_B$. The second group 304 includes three (3) cutting devices $\mathbf{104}_D$, $\mathbf{104}_D$ and $\mathbf{104}_E$ and is separated from the first group 302 along the first axis 114. The third group 306 includes four (4) cutting devices $\mathbf{104}_F$, $\mathbf{104}_G$, $\mathbf{104}_H$ and $\mathbf{104}_J$, and is separated from the first group 302 along the second axis 124.

In a variant, a fourth group of cutting devices 104 (not shown on FIG. 15) may be positioned within the cutting apparatus 300 so that this fourth group is separated from the second group 304 along the second axis 124 and separated from the third group 306 along the first axis 114. An example of this configuration is represented in FIGS. 4 and 5, in which the cutting devices $\mathbf{104}_8$, $\mathbf{104}_{10}$ and $\mathbf{104}_{12}$ form a first group distributed along the third axis 126, seventh, ninth and eleventh cutting devices (not shown) located underneath the cutting devices $\mathbf{104}_1$, $\mathbf{104}_3$ and $\mathbf{104}_5$ form a second group distributed along the third axis 126 and separated from the first group along the first axis 114, the cutting devices $\mathbf{104}_2$, $\mathbf{104}_4$ and $\mathbf{104}_6$ form a third group distributed along the third axis 126 and separated from the first group along the second axis 124, and the cutting devices $\mathbf{104}_1$, $\mathbf{104}_3$ and $\mathbf{104}_5$ form a fourth group distributed along the third axis 126 while being also separated from the second group along the second axis 124 and being separated from the third group along the first axis 114.

In the same or another variant of the cutting apparatus 300, each of the first, second or third groups 302, 304 and 306, including the fourth group, if present, may include a single cutting device 104 or a larger number of cutting devices 104. Referring again to FIG. 15, a possible implementation of the cutting apparatus 300 may only include the three (3) cutting devices $\mathbf{104}_B$, $\mathbf{104}_E$ and $\mathbf{104}_F$. It may be observed that positions of the cutting apparatus $\mathbf{104}_B$ and $\mathbf{104}_E$ as shown on FIG. 15 are at once separated along the third and first axes 126 and 114 and that the cutting apparatus $\mathbf{104}_E$ is separated from the cutting apparatus $\mathbf{104}_B$ both along the second and third axes 124 and 126. Reaching all three (3) cutting apparatuses $\mathbf{104}_B$, $\mathbf{104}_E$ and $\mathbf{104}_F$ for cutting notches on a blank profile 122 involves moving the support 118 in a 3D space over all three (3) axes 114, 124 and 126.

Still referring to FIG. 15, in the same or yet another variant of the cutting apparatus 300, the various cutting devices 104 of a given group 302, 304 or 306 may either be linearly aligned along the third axis 126 or may alternatively be separated from one another along the first and second axes 114 and 124. For example, the cutting device $\mathbf{104}_J$ is somewhat separated from the other cutting devices of the third group 306 along the first and second axes 114 and 124. As shown, the cutting device $\mathbf{104}_J$ is moved to the right along the first axis 114 and lowered along the second axis 124 when compared to the other cutting devices 114 of the third group 306. Positioning of the various cutting devices 104 within the cutting apparatuses described herein may be configured and reconfigured according to the needs of a given application.

Figure 16:
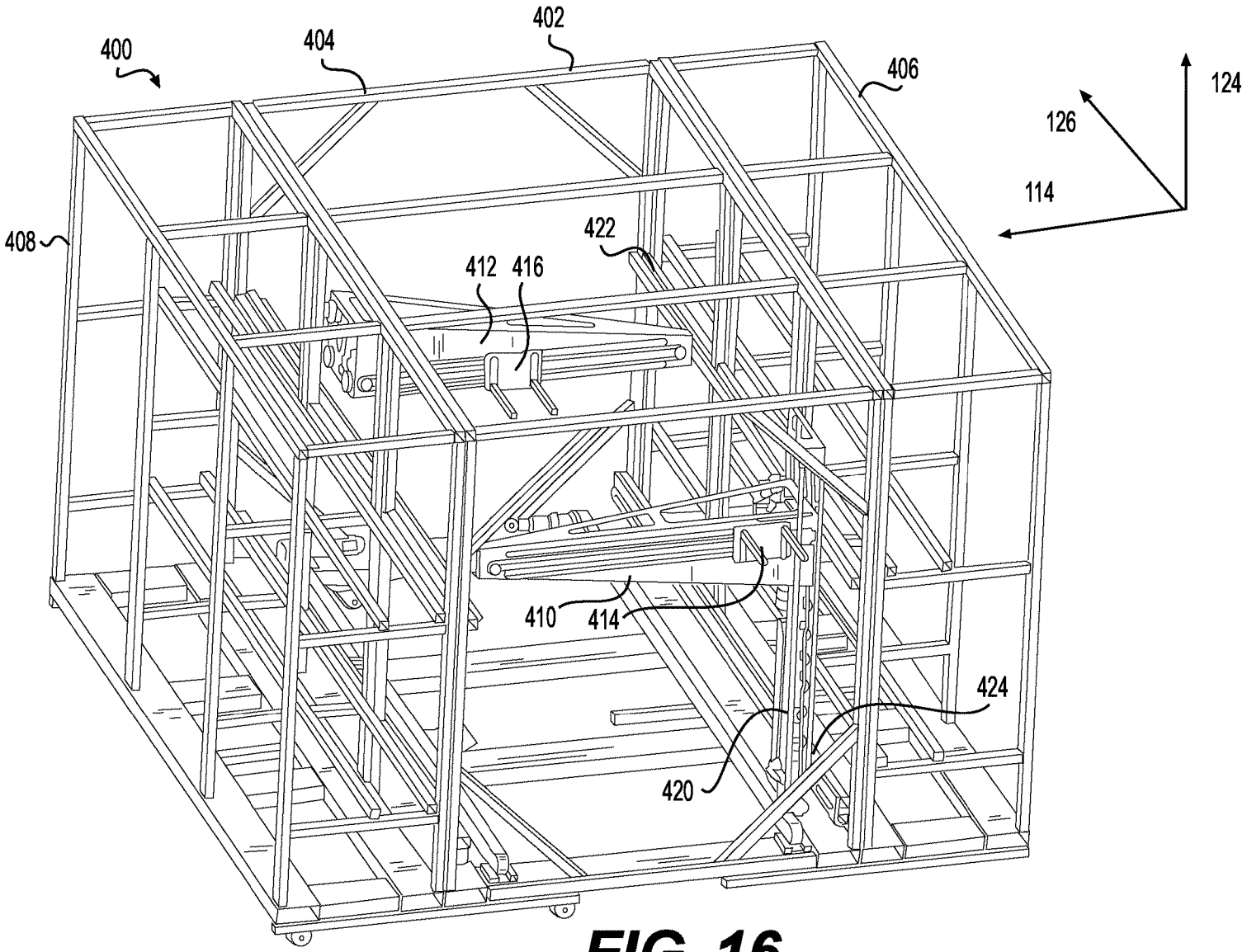
FIG. 16 is a perspective view of a partially assembled cutting apparatus having a dual-chariot configuration.

The foregoing describes embodiments of the present technology in which the chariot 116 moves along the third axis 126 while the support 118 moves along the first and second axes 114 and 124 in relation to the chariot 116, whereby the support 118 and the pallet 120 move over 3D within a cutting apparatus. However, the present technology is not limited to a particular manner of moving the support 118, the pallet 120 and the blank profile 122 toward the various cutting devices 104. FIG. 16 is a perspective view of a partially assembled cutting apparatus having a dual-chariot configuration. Cutting devices 104 of a cutting apparatus 400 are not shown on FIG. 16 but will be shown on later Figures. The cutting apparatus 400 includes a frame 402 having three (3) sub-frames 404, 406 and 408. Outer sub-frames 406 and 408 are adapted for the mounting of cutting devices 104, as will be shown in later Figures. Two (2) chariots 410 and 412 on which supports 414 and 416 are respectively mounted are installed within a central sub-frame 404.

Both chariots 410 and 412 have a similar structure, are similarly installed within the central sub-frame 404 and are operated similarly. Considering the chariot 410, it is adapted for moving along the second axis 124 by moving on a base 420, the base 420 being mounted on a pair of rails 422 and 424 of the central sub-frame 404 and being capable of moving along the third axis 126 so that the chariot 410 can effectively move along both second and third axes 124 and 126. The support 414 can move in relation to the chariot 410, along the first axis 114, so that the support 414 as well as a pallet 120 and blank profile 122 can effectively move along all three axes 114, 124 and 126.

Three (3) servo motors (not shown) may be used, respectively, to move the chariot 410 on its base 420 along the second axis 124, to move the base 420 on the rails 422 and 424 along the third axis 126 and to move the support 414 in relation to the chariot 410 along the first axis 114. Use of other mechanisms to move the chariot 410 and the support 414 is also contemplated. These servo motors as well as all cutting devices 104 are controlled by a control panel such as the control panel 216 introduced in the description of earlier Figures.

Without limitation, in the example of FIG. 16, the second axis 124 may be a vertical axis while the first and third axes 114, 126 may be horizontal axes.

Figure 17:
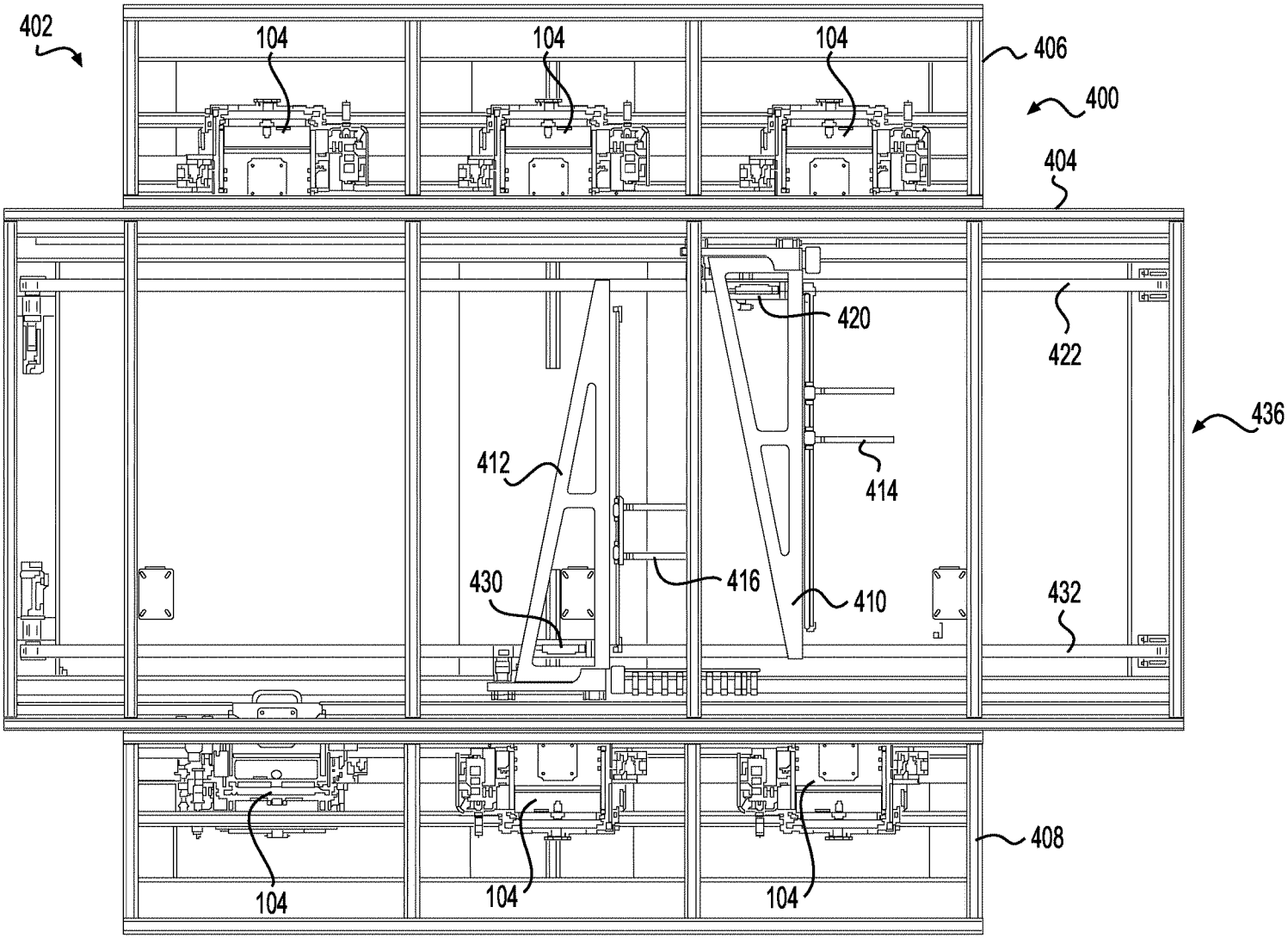
FIG. 17 is a top plan view of the cutting apparatus of FIG. 16 showing cutting devices.
Figure 18:
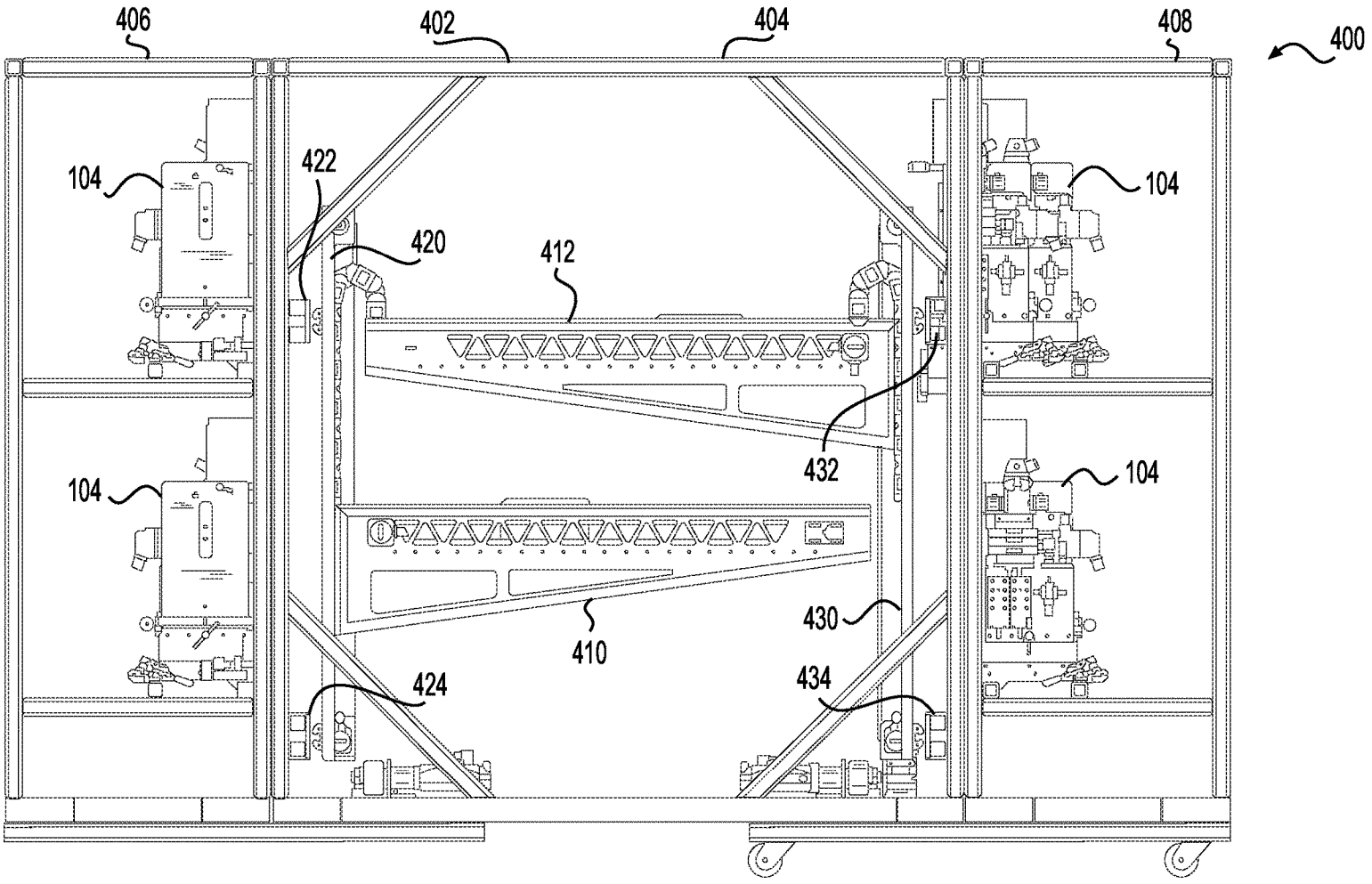
FIG. 18 is a rear elevation view of the view of the cutting apparatus of FIG. 16.
Figure 19:
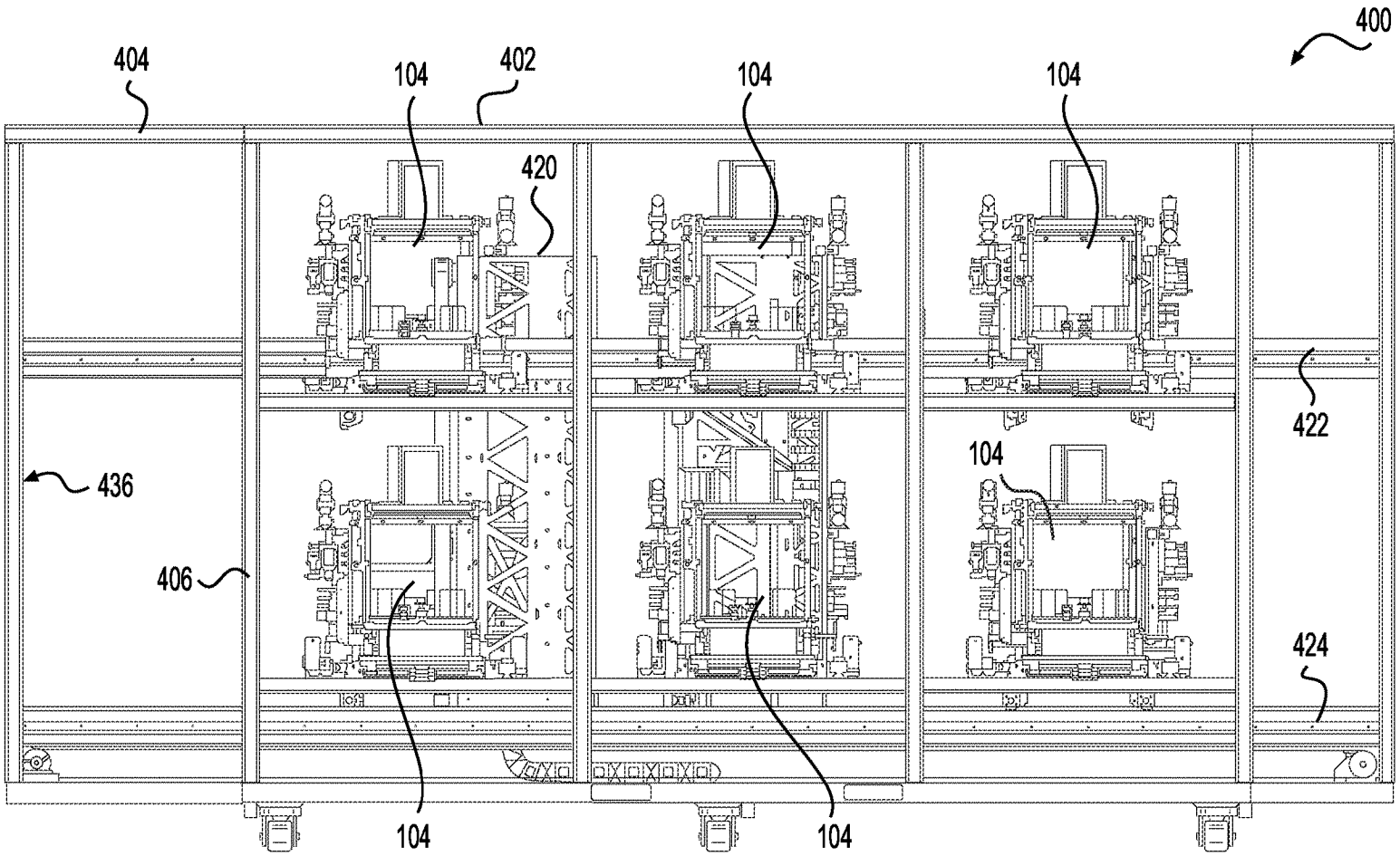
FIG. 19 is a side elevation view of the view of the cutting apparatus of FIG. 16.
Figure 20:
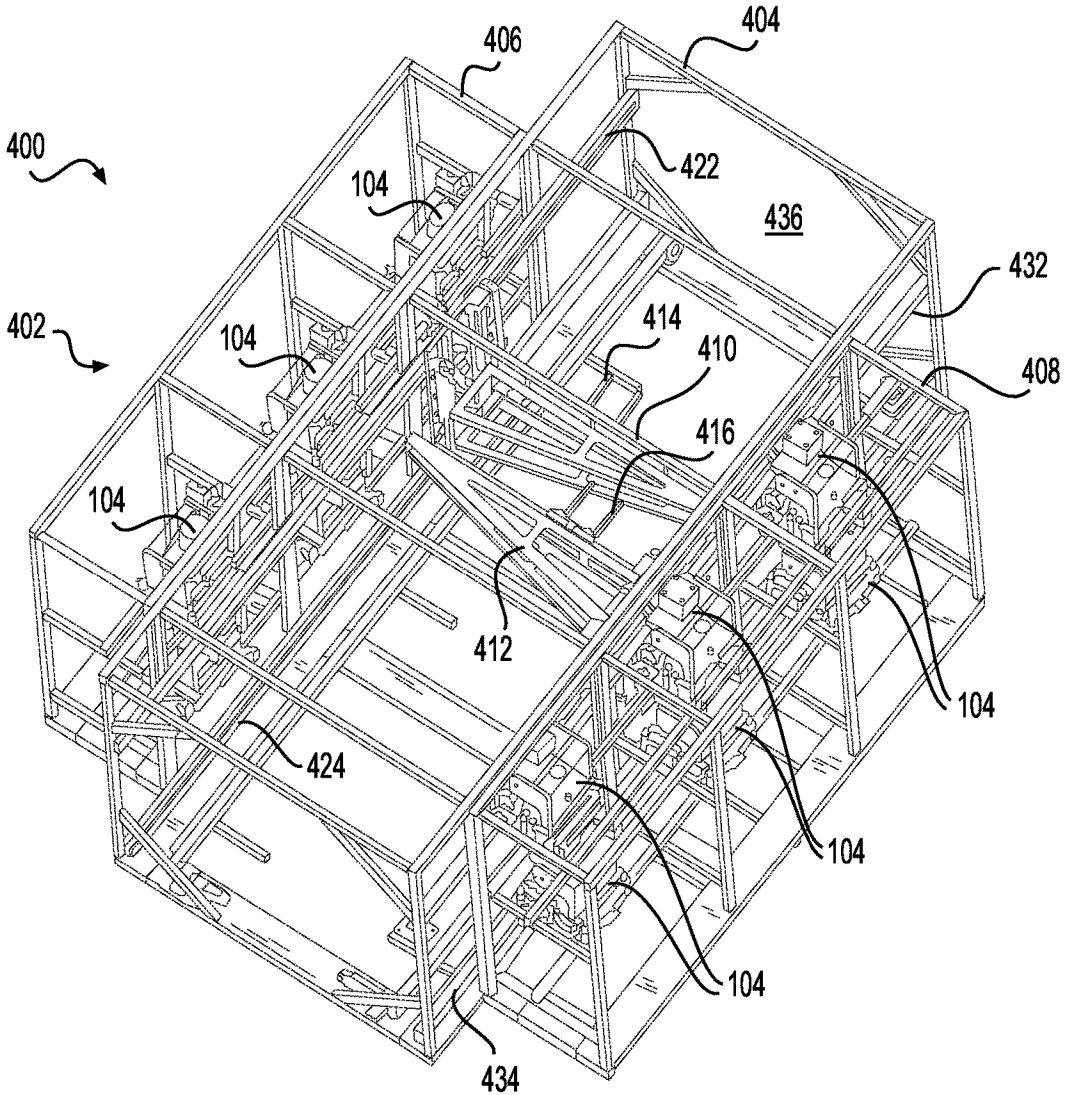
FIG. 20 is an additional perspective view of the cutting apparatus of FIG. 16.

FIG. 17 is a top plan view of the cutting apparatus of FIG. 16 showing cutting devices. FIG. 18 is a rear elevation view of the view of the cutting apparatus of FIG. 16. FIG. 19 is a side elevation view of the view of the cutting apparatus of FIG. 16. FIG. 20 is an additional perspective view of the cutting apparatus of FIG. 16. Considering at once FIGS. 16 to 20, the cutting apparatus 400 includes both chariots 410 and 412 and both supports 414 and 416. The chariot 412 is mounted on a base 430 supported by rails 432 and 434 of the central sub-frame 404. The rails 432, 434 are in a base plane of the central-sub-frame 404 that extends in directions of the second and third axes 124, 126, this base plane is parallel to another base plane defined by the rails 422 and 424. Servomotors are used to move the chariots 410 and 412 and to move the supports 414 and 416. A plurality of cutting devices 104 are disposed in the outer sub-frames 406 and 408 so that blank profiles carried by the supports 414 and 416 may reach any one of the cutting devices 104.

The control panel controls a synchronous operation of servo motors that move the chariots 410 and 412 and the supports 44 and 416, while also controlling the operation of the cutting devices 104, so that both chariots 410 and 412 between the base planes formed by the rails 422, 424, 432 and 434 without colliding. For instance, the control panel may cause the chariot 410 to move along the second axis 124 towards the rail 422, in the upper part of the central sub-frame 404 in the drawings, while causing the chariot 412 to move along the second axis 124 towards the rail 434, in the upper part of the central sub-frame 404 in the drawings. Thereafter, as the chariots 410 and 412 are separated along this second axis 124, the control panel may cause the chariots 410 and 412 and their bases 420, 430 to move in any direction along the third axis 126 and cause the supports 414 and 416 to move in any direction along the first axis 114, both chariots 410 and 412 and both supports 414 and 416 moving concurrently without risk of collision between the chariots 410 and 412 or between the supports 414 and 416.

The control panel may be installed in any one of the sub-frames 404, 406 and 408. The cutting apparatus 400 may include protective panels such as the panels 220 described hereinabove, these panels being installed as needed for safe operation and maintenance of the cutting apparatus 400.

A loading position 436 is defined at one end of the central sub-frame 404. The loading position 436 may be defined within an operator window of one of the protective panels 220 (shown on earlier Figures). The supports 414 and 416 are mounted on the chariots 410 and 412 so that they both face the loading position 436. The operator 128 may stand at the loading position 436 and install a pair of blank profiles 122 on one of the supports 414 and 416 while another pair of blank profiles 122 mounted on the other one of the supports 414 and 416 is being processed by the cutting apparatus 400. The cutting apparatus 400 may further include the display 210 and the emergency switch 218, installed near the loading position 436.

In an embodiment, each of the outer sub-frames 404 and 406 may be constructed in a manner as expressed in the foregoing description of FIG. 14 so to each include, on one side, sets of cutting devices 104 that are in an operating position of the cutting apparatus 400, each of the outer sub-frames 404 and 406 further including, on another side opposite from their operating side, a set of replacement cutting devices 104 being readied for operation. Reconfiguring the cutting apparatus 400 may be performed as expressed in the description of the cutting apparatus 200 by placing one of the sets of cutting devices 104 in the operating position adjacent to the central frame 404.

All sub-frames 404, 406 and 408 may individually fit within a standard-size container for ease of transportation. Quick-connect electrical links (not shown) may be provided between the central sub-frame 404 and the outer sub-frames 406 and 408 to facilitate connection and disconnection between the cutting devices 104 of the outer sub-frames 406 and 408, the servo-motors of the central sub-frame 404, and the control panel.

Those of ordinary skill in the art will realize that the description of the cutting apparatus and of the method of cutting blank profiles are illustrative only and are not intended to be in any way limiting. Other embodiments will readily suggest themselves to such persons with ordinary skill in the art having the benefit of the present disclosure. Furthermore, the disclosed cutting apparatus and method of cutting blank profiles may be customized to offer valuable solutions to existing needs and problems related to cost, size and maintenance needs of typical notching units. In the interest of clarity, not all of the routine features of the implementations of the cutting apparatus and of the method of cutting blank profiles are shown and described. In particular, combinations of features are not limited to those presented in the foregoing description as combinations of elements listed in the appended claims form an integral part of the present disclosure. It will, of course, be appreciated that in the development of any such actual implementation of the cutting apparatus and method for cutting blank profiles, numerous implementation-specific decisions may need to be made in order to achieve the developer's specific goals, such as compliance with application-, system-, and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of auto parts manufacturing having the benefit of the present disclosure.

The present disclosure has been described in the foregoing specification by means of non-restrictive illustrative embodiments provided as examples. These illustrative embodiments may be modified at will. The scope of the claims should not be limited by the embodiments set forth in the examples, but should be given the broadest interpretation consistent with the description as a whole.

What is claimed is:

1. A cutting apparatus for cutting blank profiles, comprising:

a first plurality of cutting devices including a first cutting device located at a first position in the cutting apparatus;

a second plurality of cutting devices including a second cutting device located at a second position in the cutting apparatus, the second position being separated from the first position along a first axis of the cutting apparatus;

a third plurality of cutting devices including a third cutting device located at a third position in the cutting apparatus, the third position being separated from the first position along a second axis and along a third axis of the cutting apparatus;

the first plurality of cutting devices forming a first row disposed along the third axis;

the second plurality of cutting devices forming a second row disposed along the third axis and separated from the first plurality of cutting devices along the first axis;

the third plurality of cutting devices forming a third row disposed along the third axis and separated from the first and second pluralities of cutting devices along the second axis;

a chariot configured to move along the third axis of the cutting apparatus; and a support mounted to the chariot, the support being configured to hold a blank profile and to move along the first axis and along the second axis of the cutting apparatus.

2. The cutting apparatus of claim 1, wherein:

the chariot is further configured to move along the second axis of the cutting apparatus; and the support is configured to move along the first axis in relation to the chariot.

3. The cutting apparatus of claim 2, comprising:

a first servo motor adapted to move the support along the first axis of the cutting apparatus;

a second servo motor adapted to move the chariot along the second axis of the apparatus; and a third servo motor adapted to move the chariot along the third axis of the cutting apparatus.

4. The cutting apparatus of claim 2, comprising:

a second chariot configured to move along the second axis and the third axis; and a second support mounted to the second chariot and configured to move along the first axis in relation to the second chariot.

5. The cutting apparatus of claim 1, comprising:

a central sub-frame containing the chariot; and a first outer sub-frame and a second outer sub-frame on opposite sides of the central sub-frame and separated along the first axis;

wherein one of the first and second outer sub-frames contains the first and third cutting devices; and wherein the other one of the first and second outer sub-frames contains the third cutting device.

6. The cutting apparatus of claim 5, wherein:

the first and outer sub-frames are detachable and separable from the central sub-frame; and each of the first and second outer sub-frames includes a pair of opposite faces, one of the opposite faces including a first set of cutting devices and the other one of the opposite faces including a second set of cutting devices, the first and second sets of cutting devices being positioned so that a rotation by 180 degrees of the outer sub-frames about the second axis and attachment of the outer-frame to the central sub-frame brings one of the first and second sets of cutting devices in a position for cutting the blank profiles.

7. A cutting apparatus for cutting blank profiles, comprising:

a first plurality of pairs of cutting devices located in a first plane of the cutting apparatus, each pair of the first plurality of pairs of cutting devices including a cutting device on each of opposite first and second sides of a third axis of the cutting apparatus;

a second plurality of pairs of cutting devices located in a second plane of the cutting apparatus, each pair of the second plurality of pairs of cutting devices including a cutting device on each of the first and second sides of the third axis of the cutting apparatus;

a chariot configured to move along the third axis of the cutting apparatus; and a support mounted to the chariot, the support being configured to hold a blank profile and to move along a first axis and along a second axis of the cutting apparatus.

8. A cutting apparatus for cutting blank profiles, comprising:

a first plurality of pairs of cutting devices located in a first plane of the cutting apparatus, each pair of the first plurality of pairs of cutting devices including a cutting device on each of opposite first and second sides of a third axis of the cutting apparatus;

a second plurality of pairs of cutting devices located in a second plane of the cutting apparatus, each pair of the second plurality of pairs of cutting devices including a cutting device on each of the first and second sides of the third axis of the cutting apparatus;

a chariot configured to move between the first and second sides of the third axis of the cutting apparatus; and a support mounted to the chariot, the support being configured to:

hold a blank profile, move along a first axis of the cutting apparatus towards either of the first and second sides of the third axis of the cutting apparatus, and move along a second axis of the cutting apparatus between the first and second planes of the cutting apparatus.

9. The cutting apparatus of claim 7, wherein:

the first plane is a first vertical plane;

the second plane is a second vertical plane;

the first axis is a vertical axis; and the second and third axes are horizontal axes.

10. The cutting apparatus of claim 7, wherein:

the first plane is a first vertical plane;

the second plane is a second vertical plane;

the first and second axes are horizontal axes; and the third axis is a vertical axis.

11. The cutting apparatus of claim 7, wherein:

the first plane is an upper plane;

the second plane is a lower plane;

the first and third axes are horizontal axes; and the second axis is a vertical axis.

12. The cutting apparatus of claim 11, comprising:

a first sub-frame adapted to enclose the chariot, the support and all cutting devices located on the first side of the first axis of the cutting apparatus; and a second sub-frame adapted to enclose all cutting devices located on the second side of the first axis of the cutting apparatus.

13. The cutting apparatus of claim 7, comprising a protective panel located at one end of the third axis of the cutting apparatus, the protective panel further comprising a window allowing operator access to the support, wherein a loading position of the support, accessible through the window, is adjustable along at least one of the first and third axes of the cutting apparatus.

14. The cutting apparatus of claim 7, wherein the support is adapted to hold a pallet, the pallet being adapted to hold the blank profile.

15. The cutting apparatus of claim 7, wherein the support is adapted to simultaneously hold two blank profiles.

16. The cutting apparatus of claim 7, wherein the cutting devices are adapted to cut blank profiles consisting of elongated metal-reinforced rubber extrusions.

17. The cutting apparatus of claim 7, wherein the cutting devices are adapted to cut blank profiles to fabricate car window sweeps.

18. The cutting apparatus of claim 7, wherein each cutting device is adapted to cut a notch at an end of the blank profile when the end of the blank profile is inserted into the cutting device.

19. The cutting apparatus of claim 18, wherein each cutting device is adapted to cut a different notch at the end of the blank profile.

20. The cutting apparatus of claim 7, comprising:

a first servo motor adapted to move the support along the first axis of the cutting apparatus; and a second servo motor adapted to move the support along the second axis of the cutting apparatus; and a third servo motor adapted to move the chariot along the third axis of the cutting apparatus.

* * * * *